US011468728B2

(12) United States Patent
Greenbaum et al.

(10) Patent No.: US 11,468,728 B2
(45) **Date of Patent: *Oct. 11, 2022**

(54) SYSTEM AND METHOD FOR REMOTE CONTROL OF MACHINES

(71) Applicant: SOFTWEAVE LTD., Kfar Vitkin (IL)

(72) Inventors: Roy Greenbaum, Herzliya (IL); Doron Midrashi, Kefar Vitkin (IL)

(73) Assignee: SOFTWEAVE LTD., Kfar Vitkin (IL)

( * ) Notice: Subject to any disclaimer, the term of this patent is extended or adjusted under 35 U.S.C. 154(b) by 0 days.

This patent is subject to a terminal disclaimer.

(21) Appl. No.: 17/192,094

(22) Filed: Mar. 4, 2021

(65) Prior Publication Data

US 2021/0192891 A1 Jun. 24, 2021

Related U.S. Application Data

(63) Continuation-in-part of application No. 17/078,654, filed on Oct. 23, 2020, now abandoned, which is a continuation of application No. 16/253,627, filed on Jan. 22, 2019, now Pat. No. 10,818,127, which is a continuation of application No. 16/104,348, filed on Aug. 17, 2018, now abandoned, which is a continuation of application No. 15/035,702, filed as (Continued)

(30) Foreign Application Priority Data

Nov. 17, 2013 (IL) ..... 229464

(51) Int. Cl.
*G07F 17/32* (2006.01)

(52) U.S. Cl.
CPC ..... *G07F 17/3211* (2013.01); *G07F 17/3223* (2013.01); *G07F 17/3225* (2013.01); *G07F 17/3244* (2013.01)

(58) Field of Classification Search
USPC ..... 463/25
See application file for complete search history.

(56) References Cited

U.S. PATENT DOCUMENTS

| | | | |
|---|---|---|---|
| 8,388,428 | B1 | 3/2013 | Black et al. |
| 10,055,931 | B2 | 8/2018 | Greenbaum et al. |
| 2002/0147047 | A1 | 10/2002 | Letovsky et al. |

(Continued)

FOREIGN PATENT DOCUMENTS

| | | | |
|---|---|---|---|
| CN | 103207760 | A | 7/2013 |
| WO | 2007100744 | A1 | 9/2007 |
| WO | 2010131859 | A2 | 11/2010 |

OTHER PUBLICATIONS

International Search Report and Written Opinion from International Application No. PCT/IL2014/050991 dated Mar. 2, 2015.

(Continued)

*Primary Examiner* — Pierre E Elisca
(74) *Attorney, Agent, or Firm* — Dorsey & Whitney LLP

(57) ABSTRACT

System and method for online/remote/spaced control of at least one machine. The method includes providing a video/image of the machine, which is to be remotely controlled by a user, displaying the video at a client station of the user, receiving from the client station input data including data indicative of the user's interaction with controls of the machine which appearing in the video, and activating the machine based on the input data.

20 Claims, 8 Drawing Sheets

Related U.S. Application Data application No. PCT/IL2014/050991 on Nov. 16, 2014, now Pat. No. 10,055,931.

(56) References Cited

U.S. PATENT DOCUMENTS

| | | | | |
|---|---|---|---|---|
| 2002/0183105 | A1 | 12/2002 | Cannon et al. | |
| 2003/0195043 | A1 | 10/2003 | Shinners et al. | |
| 2005/0272501 | A1 | 12/2005 | Tran et al. | |
| 2006/0217199 | A1* | 9/2006 | Adcox | G07F 17/3223 463/40 |
| 2007/0015583 | A1 | 1/2007 | Tran | |
| 2007/0265094 | A1 | 11/2007 | Tone et al. | |
| 2010/0178986 | A1 | 7/2010 | Davis et al. | |
| 2012/0094737 | A1 | 4/2012 | Barclay et al. | |
| 2013/0281188 | A1 | 10/2013 | Guinn et al. | |
| 2016/0019746 | A1* | 1/2016 | Lyons | G06Q 20/3224 463/31 |
| 2016/0292956 | A1* | 10/2016 | Greenbaum | G07F 17/3225 |
| 2017/0354878 | A1* | 12/2017 | Posin | A63F 13/34 |

OTHER PUBLICATIONS

Wikipedia, "Remote desktop software", Accessed Jun. 26, 2018, 3 pages.

* cited by examiner

200

205 – Providing calibration instructions.

205.1 – providing mapping data associating the controls of a gaming machine with their appearance/location in a respective video of the gaming machine, and possibly with a state of the gaming machine (in case of dynamic controls).

205.2 – providing Computer readable code for generating operational instructions for a operating gaming machine of one or more types.

210 - providing a video of at least one gaming machine and streaming the video for display at a client station.

215 - receiving input data from a client station, the input data includes data indicative of a user's interaction with controls of the gaming machine which appears in the video.

220 – managing the gaming machines by processing the input data and determine operational instructions for operating the controls of the gaming machines

220.2 - providing mapping data associating controls of the gaming machine with regions of the video.

220.4 – communicating game state data with the gaming machines

230 - utilizing the operational instructions for operating the respective gaming machines according to the user's interaction with the controls of the gaming machine which appears in the video.

240 - billing a user of a client station based on the results of his interaction with the gaming machine

Fig. 2

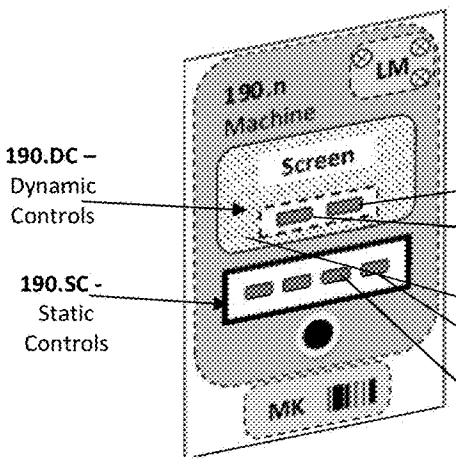

M-Ref

| Mapping Data for the Identified Machine (e.g. marked by marker MK) | | | | | | |
|---|---|---|---|---|---|---|
| | | Association between **Regions (X',Y') in the image and Controls of the Machine** | | Operational instructions for activation of the machine | | |
| C1 | C2 | C3 | | C4 | | |
| | | Control | Coordinates/Regions **(X',Y') in the Image - IMG** | User Interaction | Operational Instructions for: | |
| Dynamic Controls | State 1 | Touch Screen Button C | $(X'^1_C,Y'^1_C)$ - $(X'^2_C,Y'^2_C)$ | Click | Click on the touch screen button C | R1 |
| | | | | Right Click | display help for Button C | R2 |
| | | Touch Screen textbox D | $(X'^1_D,Y'^1_D)$ - $(X'^2_D,Y'^2_D)$ | Typing | Text entry into textbox D | R3 |
| | State 2 | Touch Screen In-General | $(X'^1_E,Y'^1_E)$ - $(X'^2_E,Y'^2_E)$ | Cursor Move/ Click | Cursor Movement on Sending sub coordinates of touch screen click on all areas in touch screen | R4 |
| Static Controls | Stateless controls | Physical Button A | $(X'^1_A,Y^1_A)$ - $(X'^2_A,Y'^2_A)$ | Click | Push on Button A | R5 |
| | | | | Right Click | Display help for Button A | R6 |
| | | Handle B | $(X'^1_B,Y'^1_B)$ - $(X'^2_B,Y'^2_B)$ | Drag | Push the handle B | R7 |

Table A

Fig. 4B

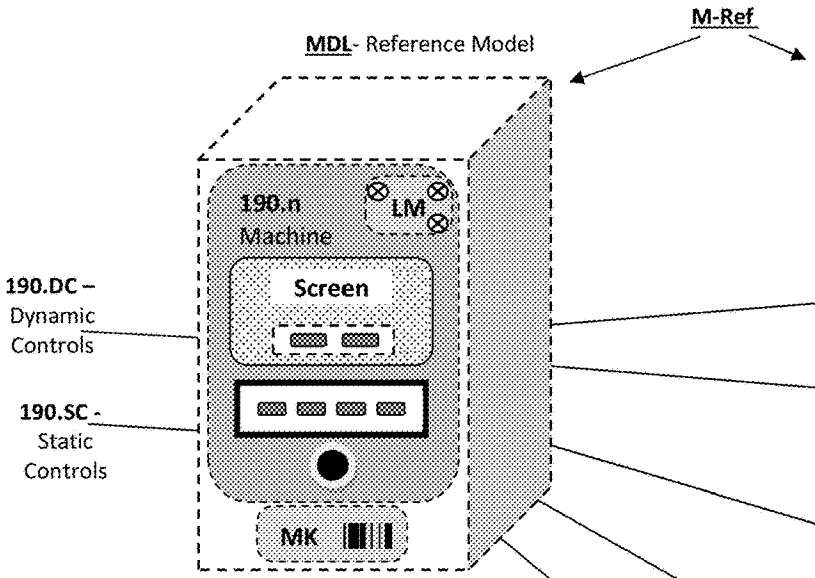

Fig. 4C

| Mapping Data for the Identified Machine (e.g. marked by marker MK) | | | | | | |
|---|---|---|---|---|---|---|
| | | Association between **Regions (X,Y) in the Model MDL and Controls of the Machine** | | Operational instructions for activation of the machine | | |
| C1 | C2 | C3 | | C4 | | |
| | | Control | Coordinates/Regions (X,Y) in **the Model MDL** | User Interaction | Operational Instructions for: | |
| Dynamic Controls | State-1 | Touch Screen Button C | $(X^1_C,Y^1_C)$ - $(X^2_C,Y^2_C)$ | Click | Click on the touch screen button C | R1 |
| | | | | Right Click | display help for Button C | R2 |
| | | Touch Screen textbox D | $(X^1_D,Y^1_D)$ - $(X^2_D,Y^2_D)$ | Typing | Text entry into textbox D | R3 |
| | State -2 | Touch screen In-General | $(X'^1_E,Y'^1_E)$ - $(X'^2_E,Y'^2_E)$ | Cursor Move/Click | Coordinates of Cursor Movement/Click on the Machine's Touch Screen | R4 |
| Static Controls | Stateless controls | Physical Button A | $(X^1_A,Y^1_A)$ - $(X^2_A,Y^2_A)$ | Click | Push on Button A | R5 |
| | | | | Right Click | Display help for Button A | R6 |
| | | Handle B | $(X^1_B,Y^1_B)$ - $(X^2_B,Y^2_B)$ | Drag | Push the handle B | R7 |

Table B

400

410 - Communicating imagery IMG of machine 190.1 to client station's display 170.Disp

415 - Identifying the machine 190.1 displayed by the imagery IMG

416 - Obtaining reference mapping data M-Ref indicative of the association between regions of the imagery IMG and respective controls of the machine 190.1 appearing thereat 417 - Obtaining data indicative of user's interactions with client station's display 170.Disp

422 - Mapping user's interactions with the display 170.Disp to respective machine controls in the image IMG

423 - Determining spatial registration between the image of the machine 190.1, IMG, and reference model MDL thereof in the reference mapping data M-Ref

424 - Determining operational instructions to be issued for activating the machine 190.1 according to the user's interactions 425 - Determining the state of the machine and thereby determining the presented dynamic controls 190.DC of the machine or the operation of its controls 190.DC or 190.SC

430 - Relaying/communicating the operational instructions for activating the machine 190.1 to the machine 190.1 or its controls 190.SC and/or 190.DC (by the relay/communication module 130, possibly via the server 150, or possibly via the relay devices/circuits 130.1 coupled to the machine 190.1 or to its controls 190.SC and/or 190.DC

431 – Direct relay via a network/data connection 190.DT of the machine 190.1

432 – InDirect relay via relay devices/circuits 130.1 coupled to the machine 190.1 or to its controls 190.SC and/or 190.DC

433 – Direct or indirect relay via intervening remote control server 150

Fig. 5

SYSTEM AND METHOD FOR REMOTE CONTROL OF MACHINES

TECHNOLOGICAL FIELD

The present invention relates to techniques for control of systems/machines and more specifically, provides systems and methods for delivering remote control services for machines over a network.

BACKGROUND

There are many gaming sites and applications that are used by game users for playing and possibly also gambling on-line. In some cases the majority of games provided on-line by such sites and/or applications resemble conventional casino games/gaming machines. For example, typical on-line gaming/casino sites may include virtual video slot machines, virtual video poker machines, and even virtual mechanical slot machines.

Actual/physical gaming machines, such as those placed in casinos, are typically, in many jurisdictions, kept under strict regulations for ensuring that such gaming machines are reliable and that they provide predetermined typically a-priori known (e.g. published) return rates and/or winning chances/gambling odds. For example, a game of an actual casino gaming machine may be implemented by computer software that is stored on computer chips, which are regulated/supervised and are associated with serial numbers to prevent their forgery and/or unauthorized replacement. For example, the relocation and/or replacement of a computer chip carrying the game logic/software in a gaming cabinet, and/or updating the software on the chip are performed under strict regulations which ensure reliability of the gaming machine.

Indeed, there are some known techniques that are aimed at improving the versatility of gaming machines, and more particularly improving the versatile use of gaming machines cabinets, located on a casino house. For example U.S. patent publication No. 20070265094 provides a system and method for streaming games and services to gaming devices, such as gaming cabinets. According to this technique the gaming system provides a game and/or gaming services to a player or user at a gaming or gaming services device. The device receives streaming audio-video representing the game or gaming services and plays streaming audio-video at a device. The device also receives input related to the play of the game or the gaming services from the user/player and relays the input to the gaming system. The system includes a storage device and a controller. The storage device stores elements of the game and/or gaming services. The game controller receives the input from the user/player and responsively retrieving the elements of the game and/or gaming services from the storage device, dynamically creates an audio-video stream as a function of the retrieved elements and the input, and broadcasts the audio-video stream to the gaming and/or gaming services device.

GENERAL DESCRIPTION

This a need in the art for a novel technique for remote control of machines, and particularly for remote control of machines without touching the machine or without being physically nearby, via a client station/device of a user seeking to control the machine.

For instance, many existing on-line gaming sites and/or gaming applications are aimed at providing users with an experience similar to that of a real-life casino. To this end, typically such sites/applications offer their users games similar to those existing in actual casino gaming machines, and also provide users with gambling options similar to those available at conventional casinos.

Yet a major difference between actual/physical casino games/gaming machines and their virtual implementations provided by such on line sites, stems from that actual casino gaming machines typically provide predetermined and in many cases a-priori known/published gambling odds (e.g. gambling return rates and/or winning chances), which are, as noted above, are under strictly regulations in at least some jurisdictions. However, in some virtual on-line gaming sites/applications (e.g. offering virtual casino experience), the virtual games/gaming machines are not under strict regulations and are not supervised, and their users cannot determine reliability of the virtual gaming machine and/or its actual gambling odds. Also, in jurisdictions, which do impose some regulation on such on-line gaming sites/applications, the on-line/virtual machines are typically more loosely regulated than actual casino gaming machines. In this connection, often the users of such on-line sites/application fail to distinguish between the un-regulated virtual gaming machines and regulated/loosely-regulated virtual gaming machines.

Consequently, as land-base/actual casino gaming machines typically go through better regulatory process than the online games, are often perceived by users as being more reliable/repayable than their counterpart virtual machines, typically offered by on-line sites/applications. Accordingly the user's experience when playing actual casino gaming machines is often better than that obtained when the user engage with the counterpart virtual machines.

Moreover, actual casino gaming machines often offer higher entertainment value than their counterpart virtual/on-line gaming machines. This is because in many cases the virtual/on-line machines are restricted in their processing requirements and files' sizes, and accordingly the games they provide are stripped of a lot of the qualities and/or functionalities existing in the actual machines. This results with reduced quality of the overall look and feel and/or sound, and accordingly the quality of the users experience when engaged with such virtual gaming machines.

Techniques, such as that of U.S. patent publication No. 20070265094, which are aimed at centralizing the logic of gaming machines on centralized gaming servers, are in some cases used for providing conventional on-line games, and/or for improving the versatility of gaming cabinets in the casino-house and the diversify the games offered thereby, without requiring regulatory inspection. As noted above, even if the on-line games provided by such systems are strictly regulated, they are often conceived un-reliable by the users, since they appear similar to the other on-line games which may be not regulated.

It is also noted that a similar need for remote control of machines exists in the art due to users seeking to avoid touch with public machines they in need of using (e.g. in order to avoid transfer of disease/virus/germs). This is particularly true for public or industrial machines that are generally controlled from time to time by many users. To this end the present invention provides a novel technique for remote control of machines without touching the machine or without being physically nearby, via a client station/device of a user seeking to control the machine.

The present invention may be used to improve the user's experience when playing and/or gambling on-line by providing methods and systems for enabling users to conduct on-line games on actual/physical gaming machines (e.g. allowing users to engage from afar with gaming machines/cabinets, which may be placed in actual casino halls).

The systems and methods of the invention are adapted for providing the remote users with video footage of the actual machine or machine cabinet (e.g. of gaming machines, ATMs, public machine, industrial machines, medical equipment/machines or household machines), and for receiving form the users input data indicative of their interaction with the video-footage, and more specifically with the controls of the appearance of the machine, in the video-footage of the actual machine. The user's interactions with the video-footage, are than mapped to the controls of the gaming machine appearing therein (e.g. based on predetermined/calibration data or real time mapping associated with the location of these controls in the video of the machines/cabinets), and the mapped interactions are then relayed to the machine (e.g. to the machine's local controller/computer or remote server which carries the logic of the machine). The relay may be performed via external circuitry connectable to machine's computer/controller/server (e.g. circuitry connecting the computer to the physical controls of the machine, which are located in the cabinet).

In this way the system of the present invention may be used to improve reliability of the experience provided to on-line users by allowing the users to play/operate real machines such as gaming machines/ATMs or the like are whose cabinets are visualized to the users at their client stations and interacted by the users.

Also the system of the present invention enables casino operators to maximize/optimize the return they get from the gaming machines located at their casino. Currently, typically gaming machines in a casino are occupied only between 30-50% of the time. By enabling casino operators to offer on-line games on one or more of their gaming machines, the present invention allows the casino operators to get more traffic onto the gaming machines to increase their utilization.

It should be noted here that in the present disclosure the term on-line gaming relates to playing the actual casino gaming machines remotely from the gaming machines, while communicating a video of the gaming machine and possibly additional data required for the game via a communication network.

The terms communication network and network herein may designate the Internet/Ethernet network, and/or any communication network enabling data and video transfer between the client station of a user and the system of the invention. For example such network may include a Local Area Network (LAN), a Wide Area Network (WAN), wireless network such as cellular network and WIFI, and/or any other suitable combination networks.

Thus, according to a broad aspect of the invention there is provided an online gaming system that is configured to obtain a video of at least one gaming machine and streaming the video for display at a client station of a user. The online gaming system is adapted for receiving input data from the user, including data indicative of the user's interaction with controls (e.g. buttons/touch screen) of the gaming machine appearing in the video. The online gaming system is configured and operable for activating the gaming machine based on the user input.

It should be noted that in the present application the term video should be construed as including imagery data/signals and possibly also audio data/signals of the machine. In particular, the imagery data may be data obtained from a camera directed to capture the machine and may include images at least partially presenting the machine's cabinet with the display and the controls of the machine on the cabinet. The audio data may be obtained from a microphone placed for capturing sound emanating from the speakers of the machine or its cabinet (e.g. a microphone associated with the camera), and/or it may be obtained from a sound relay module connectable to the circuitry of the machine (e.g. to the circuitry associated with the speakers of the machine and/or to the sound card of the machine).

In some embodiments of the present invention the online machine's remote control system includes:

a video streaming module that is connectable to at least one camera and adapted for receiving from the at least one camera a video of said at least one machine and for streaming the video (e.g. via a network or internally/locally) to a client station being spaced/remote from the machine;

a machines manager module that is adapted for receiving the input data from the client station, and for processing the input data to determine operational instructions (analogue/digital data/signal) for operating said machine; and a relay module that is connectable to the machine and adapted for receiving the operational instructions from the machines manager module and for accordingly operating the machine.

In some embodiments of the present invention, data indicative of the user's interaction with the controls of the machine that appear in the video, is included in the input data obtained from the users. Particularly in some cases the data indicative of the user's interaction with the controls of the machine includes and/or is in the form of data indicative of the user's interaction with one or more regions of the video. The machines manager module may include a controls mapping module that is configured and operable to process a user's interactions with the one or more regions of the video/imagery and to associate them with activation of controls of the machine that appear in these regions of the video/imagery. Accordingly the operational instructions for activating controls of the machines are determined by the machines manager module.

In another aspect of the present invention there is provided a method for online remote control of machines. The method includes: (i) providing a video/imagery of at least one machine and streaming that video for display at a client station of a user; (ii) receiving input data from the user, including data indicative of the user's interaction with controls of the machine appearing in the video; and (iii) activating the machine based on said input data.

In some embodiments of the present invention the method includes acquiring/receiving/obtaining video/imagery from a camera positioned to capture the machine. The camera may be included as part of the system of the present invention, and/or it may be a peripheral module connected to the system. The camera may be for example an imager of a client' s/user' s station such as a mobile/smart phone of a user by which some parts of the system of the present invention may be executed, either locally or over the network, e.g. on the "cloud". The received video is streamed via a network to the client station being remote/spaced from the machine.

In some embodiments of the present invention the activation of the gaming machine includes processing the input data received from the client station to determine operational instructions for operating the machine. The activation of the machine according to the present invention may also include operating the machine based on the operational instructions determined from the input data, by utilizing a relay module (e.g. a network communication module) and/or a relay device/circuit that is/are configured and operable for connecting/communicating with the machine.

In some embodiments of the present invention the data indicative of the user's interactions with the controls of a machine includes data indicative of the user interactions with one or more regions of the video/imagery, in which one or more of the controls of the machine appear. The method includes processing the input data by mapping the regions of the video with respective controls of the gaming machines appearing therein to thereby associate the user interactions with activation of the respective machine's controls.

According to yet another broad aspect of the present invention provided is a system for remote control of machines via a user's client station that includes a user interface facilitating user interaction with the display. The system is configured and operable to carry out the following:

obtaining imagery (e.g. a video) of at least one machine having controls;

displaying at least part of said imagery at the display of the client station of the user;

receiving an input data from the user via the user interface of the client station; and activating the machine based on the input data;

the input data is indicative of interactions of said user with one or more regions in said imagery IMG of the machine that is being displayed at the display of the client station, at which respective one or more of said controls of the machine appear. The system includes a machine manager for processing the input data for associating the respective one or more controls of the machine with the one or more respective regions of said imagery with which the user interacted, and thereby map the user interactions with the one or more respective regions in said imagery to one or more of said respective controls, and determining certain operational instructions for activating the machine in accordance with the user interactions with the appearance of the one or more respective controls in said one or more regions in the imagery of the machine, which is displayed at the display of the client station.

According some embodiments of the present invention the system is at least partially implemented at said client station and comprising said display and said user interface.

According some embodiments of the present invention the machine manager of the system includes a controls' mapping module (e.g. controls mapper) is configured and operable to obtain reference mapping data indicative of association between the one or more regions and said one or more respective controls of the machine.

The input data provided by the user interface may for example include data indicative of a type (e.g. click, double-clear, hover, drag, etc.) and coordinates, of the user interaction with said respective regions of the display at which said displayed part of the imagery of the machine with the respective one or more controls is displayed. The controls' mapping module may be configured and operable to obtain the reference mapping data such that it further includes data indicative of corresponding one or more operational instructions for activation of said one or more controls of the machine in response to the corresponding user interactions with the one or more regions of the display at which said one or more respective controls appear; and the machines manager may further be configured and operable to carrying out the determining of the certain operational instructions by selecting the certain operational instructions from the corresponding one or more operational instructions in accordance with the user interaction with the region of the display at which appears a corresponding control of said one or more respective controls.

According some embodiments of the present invention the system further includes:

a machine identifier module configured and operable for determining data indicative of an identity of the machine being captured by the imagery; and a reference data retriever module configured and operable for utilizing the data indicative of the identity of said machine to retrieve said reference mapping data for the identified machine (e.g. for storage/temporary-storage in the mapping memory of the control's mapping module).

The reference mapping data may for example include: (i) data indicative of a reference model of appearance of the identified machine, and (ii) reference map associating one or more regions of the reference model with one or more respective controls of the identified machine located at said regions of the reference model respectively. The controls mapping module may for example be configured and operable for processing the reference map associating the one or more regions of the reference model with one or more respective controls of the identified machine based on the spatial registration between said reference model and the displayed part of the imagery IMG, and thereby determine an actual map associating the one or more regions of at least said displayed part of the imagery IMG of the captured machine 190.1 with the one or more respective controls (e.g. touch screen buttons or leavers/handles) of the identified machine 190.1 located at said regions of displayed part of the imagery and their corresponding operational instructions for activating said respective controls of the identified machine [e.g. click on coordinates (X,Y) of the touch screen]. In turn, the machine manager is configured and operable for utilizing the actual map to carrying out the associating of the respective one or more controls of the machine with the one or more respective regions of the imagery with which the user interacted, to thereby accordingly carrying out said determining of the certain operational instructions.

According to some embodiments of the present invention the machine manager is further configured and operable for issuing an activation communication for activating said machine based on said certain operational instructions associated with said control of the machine displayed at said coordinates.

According to some embodiments of the present invention the machine identifier is connectable to a positioning module and is configured and operable for receiving data indicative of a position of at least an imager by which said imagery of a machine is captured, and utilizing said data to determine the identity of the machine based on said position of the system. For example, the machine may be assumed to be in vicinity of the position of the imager associated with the system, and the machine identifier utilizes machines reference data (machine lookup-table (LUT)) associating a plurality of machines with respective positions a thereof and determines the identity of said machine based on proximity between the position of the machine and the position of said system.

In some implementations machine identifier is connectable a marker reader adapted to read an identification marker associated with said machine. For example, the identification marker may be a visible identification marker appearing on said machine and including at least one of a barcode or a visible form identifying said machine; and the marker reader may include an image processor adapted to process an image of the machine to recognize the identification marker of the machine thereby determine said identity of the machine.

In some implementations the machine identifier module may utilize machines reference data (machine LUT) associating a plurality of machines with respective identification markers thereof, and thereby determine the identity of said machine based on the machines reference data. In some implementations the machines reference data (machine LUT) resides at a server remote from the system and the machine identifier is configured and operable to access said server. Alternatively or additionally, the identification markers may be directly indicative of the identities of the respective machines marked thereby (e.g. obviating the machine LUT).

In some implementations of the invention, the reference mapping data resides at one or more servers remote from the system and the system includes a reference data retriever configured and operable to access said one or more servers for retrieval of said reference mapping data.

In some implementations of the invention, the imager is mobile thereby providing said imagery of the machine with non-predetermined position and orientation coordinates relative to said machine. According to some embodiments of the present invention the system the reference model in the reference mapping data includes one or more reference (e.g. alignment) landmarks appearing on the machine. The image/video processing module may be configured and operable to process at least a displayed part of the imagery of the captured machine to identify appearance of the landmarks therein, determine a landmarks' spatial registration indicative of the registration between the reference landmarks in the reference model and the appearance of the reference landmarks in the imagery and processing said landmarks' spatial registration utilizing at least one of extrapolation and interpolation, to determine the spatial registration (e.g. fitting) between the reference model and the displayed part of the imagery of the captured machine.

Alternatively or additionally, in some implementations the reference model comprises a reference image of at least a part of the machine. In these cases, the image/video processing module may be configured and operable to apply image/pattern recognition determine the special registration between the reference model and the displayed part of the imagery of the captured machine.

According to some embodiments of the present invention for determining the spatial registration, the image/video processing module carries out at least one or both of the following:

- applies one or more spatial transformations to the imagery of the at least part of the machine, to obtain one or more transformed images, and determine the transformed image having a best fit with said reference model and a corresponding spatial transformation associated therewith, and determining the spatial registration based on the corresponding spatial transformation;
- applies one or more spatial transformations to the reference model to obtain one or more transformed models, and determine the transformed model having a best fit with the imagery of the at least part of the machine reference model and a corresponding spatial transformation associated therewith, and determining the spatial registration based on said corresponding spatial transformation.

The spatial transformation may for instance include a combination of one or more of the following carried out with respect to one or more scaling or rotation: tilt, rotate, warp, scale, perspective transformation, zoom-in/out.

In some embodiments the imagery is video imagery whereby appearance of said machine may move relative to frame of said video imager, and wherein said image/video processing module is adapted to track the spatial registration across the video frames. The tracking of the spatial registration may for instance include use of optical comparison techniques between image frames of the video, such as optical flow. Alternatively or additionally, the tracking of the spatial registration comprises utilizing inertial sensors (e.g. accelerometer or gyro e.g. on a client device/station which carries the imager) to monitor movements of said system and utilize said movements at least one of:

- update said spatial registration according to said movements;
- stabilize said displayed imagery of the at least part of the machine shown on said display based on said movements.

According to some embodiments of the present invention the image/video processing module is configured and operable to determine said spatial registration/fit between the reference model and the displayed part of the imagery of the captured machine such that said spatial registration includes a model-mapping of one or more respective spatial regions of the machine's model in the reference data to one or more spatial regions (pixels or pixel groups) in the imagery of the captured machine. The control's mapping module (mapper) may be configured and operable for utilizing said model-mapping to map the one or more respective controls of the identified machine located at the respective spatial regions of the machine-model to corresponding spatial regions of said displayed part of the imagery of the captured machine at which the control appear, and thereby determine said actual mapping data associating respective spatial regions of said displayed part of the imagery of the captured machine with corresponding operational instructions for activating the corresponding controls of the identified machine, which appear at said spatial regions of the imagery of the captured machine, upon user interaction with the respective spatial regions of the imagery at which said corresponding controls appear. The model-mapping may be for example a spatial transformation which when applied to the reference model yields said actual mapping data. Alternatively or additionally, the model-mapping may be a lookup-table mapping pixels of the imagery to regions of said reference model.

According to some embodiments of the present invention the system is connectable to the imager and configured and operable for receiving said imagery indicative of a video stream of the machine to be remotely controlled. According to some embodiments of the present invention the system includes the imager. The system may be for example implemented on a mobile communication device of a user (e.g. on mobile phone/smartphone, laptop, PDA, tablet, etc.). The system may include a network module configured and operable for communicating with an application-server serving as a machines remote control server over a network to carry out the following:

(a) provide said server, with machine identification data indicative of the identity of the machine captured by the imager to receive, in response from said server, said data indicative of the reference mapping data of said machine;

(b) provide said server, with the activation communication data indicative of certain operational instructions for activating said machine according to the user interaction with said control of the machine displayed at said coordinates of the display with which said user has interacted, based on the type of interaction of said user with said coordinates at which said control of the machine appears on said display.

The server may for instance include/store the machines reference data (machine LUT) associating a plurality of machines with respective machine identification data thereof, e.g. the machine identification data may include at least one of: data indicative of a position of said machine; data indicative of appearance of said machine; and data indicative of identification markings/indicia (tagging/barcode) of the machine.

In response to said activation data, the server establishes a communication with a communication module associated with at least one of: (i) a controller of said machine, and (ii) a relay device connected to the controls of the machine, for providing said certain operational instructions thereto; and wherein said at least one of the (i) controller of said machine and the (ii) relay module connected machine, is configured to receive said operational instructions and activate the machine accordingly.

According to yet another broad aspect of the present invention there is provided a machines remote control server configured and operable for operating over a network to carry out the following:

(a) provide reference machine data to a client device of a user, comprising:
  i) receiving machine identification data indicative of the identity of a machine captured by an imager of a user;
  ii) processing said identification data utilizing machines reference data, which is stored in memory associated with said server and comprises data associating a plurality of machines with respective machine identification data thereof, to determine identity of said machine;
  iii) utilizing said identity of the machine to search in a reference data storage for reference machine data associated with said machine, including: (i) reference model of appearance of the identified machine, and (ii) reference mapping data associating one or more regions of said reference model with one or more respective controls of the identified machine located at said regions of the reference model respectively, and corresponding operational instructions for activating said respective controls of the identified machine;
  iv) provide said reference machine data to the client device of the user; and (b) activate the machine based on operational instructions from the client device of a user, client device of a user, comprising:
  i) receiving, from the client device, activation communication data indicative of certain operational instructions for activating the machine according to user's interaction with a control of the machine displayed at certain coordinates of a display of the client device with which a user of said device has interacted, and at which said control of the machine appears on said display;
  ii) utilizing the identification data of the machine to determine, based on said machines reference data (e.g. machine LUT), which is stored in the memory associated with said server, communication parameters of for communicating with said machine directly or via a relay;
  iii) utilizing said communication parameters for establishing of for communicating with said machine directly or via a relay, to provide said machine directly, or said relay with instructions for activating said machine according to said certain operational instructions.

Typically, according to some embodiments of the present invention, the machines remote control server includes:

A network communication module;

Reference data storage comprising:
  the machines reference data associating a plurality of machines with respective machine identification data thereof; and
  reference mapping data per each machine of the plurality of machines in the machines reference data, including: said (i) reference model of appearance of the identified machine, and said (ii) reference mapping data associated with each said machine;

a processor;

machines reference data retriever executed by said processor and configured and operable to utilize said network communication module and said reference data storage to carry out the operation (a).

machine's manager (also referred to herein as machine activator) executed by the processor and configured and operable to utilize the network communication module to carry out the operation (b).

According to further yet another broad aspect of the present invention there is provided a method for remote control of machines via a user's client station that includes a display and a user interface. The method includes:

obtaining imagery of at least one machine having controls;

displaying at least part of said imagery at the display of the client station of the user;

receiving an input data from the user via the user interface of the client station; and activating said machine based on the input data;

The input data is indicative of interactions of said user with one or more regions in said imagery of the machine that is being displayed at the display of the client station, at which respective one or more of said controls of the machine appear. The method includes processing the input data for associating said respective one or more controls of the machine with said one or more respective regions of said imagery with which the user interacted, thereby mapping the user interactions with the one or more respective regions in said imagery to one or more of said respective controls, and determining certain operational instructions for activating said machine in accordance with the user interactions with the appearance of the one or more respective controls in said one or more regions in the imagery of the machine, which is displayed at the display of the client station.

According to further yet another broad aspect of the present invention there is provided computer readable/executable code tangibly embodied in a storage machine and configured and operable for implementing the methods and/or systems described herein (e.g. the method steps and/or system modules/elements) when executed by a computerized system. Thus, the present invention provides methods and systems for remote/on-line operation of machines (e.g. actual gaming machines such as those located at casino houses, ATM's or other industrial medical devices/machines, or household machines and/or other systems having user controls/interface). For example, the technique of the invention allows providing the users of the system with improved ability to control machines from afar. In some aspects the present invention may be used to provide users with improved gaming experience and with the gaming reliability compared to those provided by the real casino gaming machines by allowing the users to interact with the gaming machines remotely. In aspects the present may be used to provide user with ability for touchless (remote) control of machines. Additional aspects and embodiments of the present invention are further described in more details in the detailed description section below.

BRIEF DESCRIPTION OF THE DRAWINGS

In order to better understand the subject matter that is disclosed herein and to exemplify how it may be carried out in practice, embodiments will now be described, by way of non-limiting example only, with reference to the accompanying drawings, in which:

FIG. 2 is a flow chart schematically illustrating a method for providing on-line gaming services according to an embodiment of the present invention;

FIGS. 4B and 4C exemplify possible structure and/or content of the reference mapping data for use in mapping user's interactions on his client station to operational instructions of a machine, for two cases where the position/orientation of the imager capturing the machine may be fixed/a-priory-known or mobile;

FIG. 5 is a flow chart schematically illustrating a method 400 for providing on-line/remote/touchless control of machines according to an embodiment of the present invention.

DETAILED DESCRIPTION OF EMBODIMENTS

Figure 1:
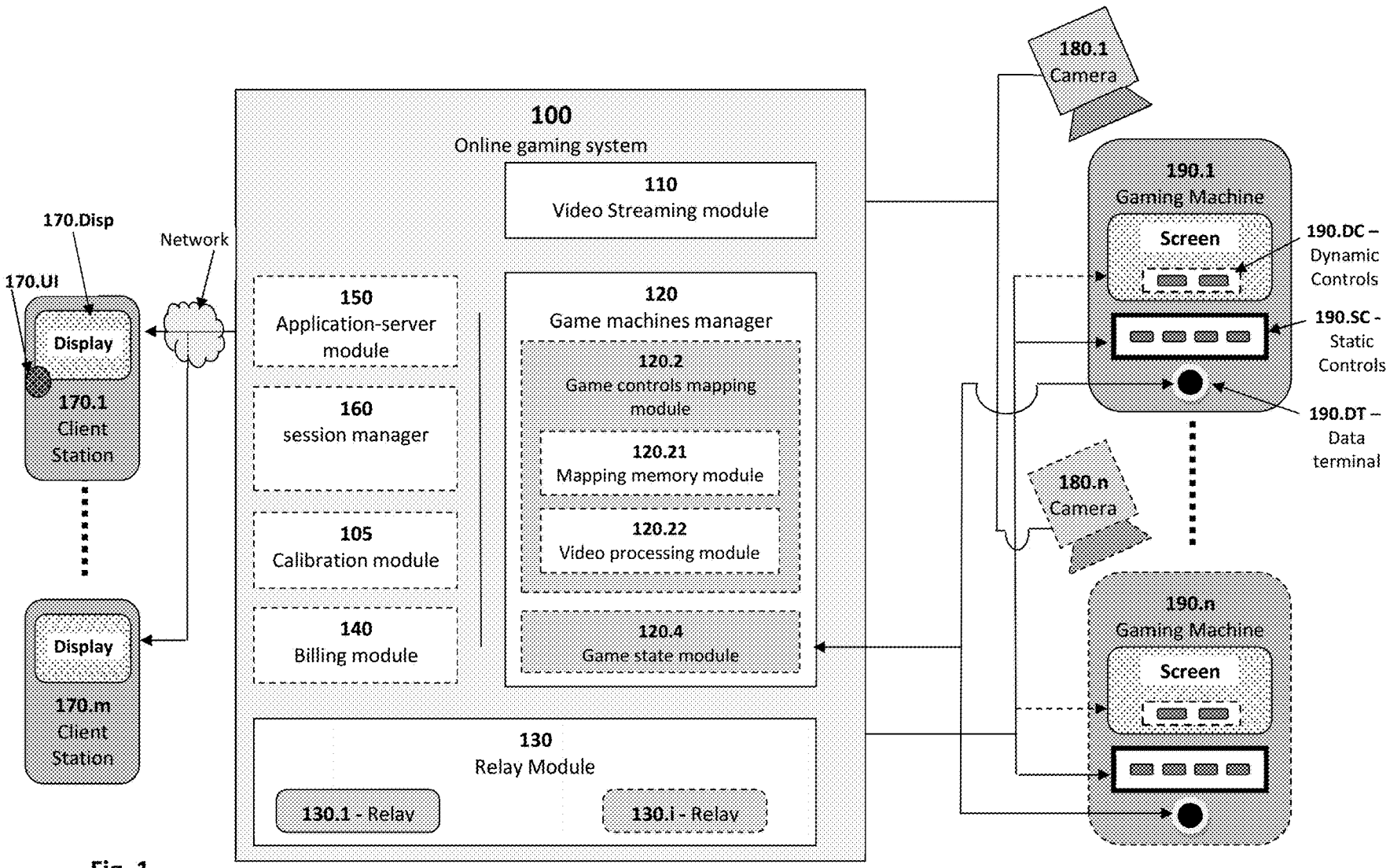
FIG. 1 is a block diagram 100 illustrating an on-line remote control system configured and operable according to an embodiment of the present invention.
Figure 4A:
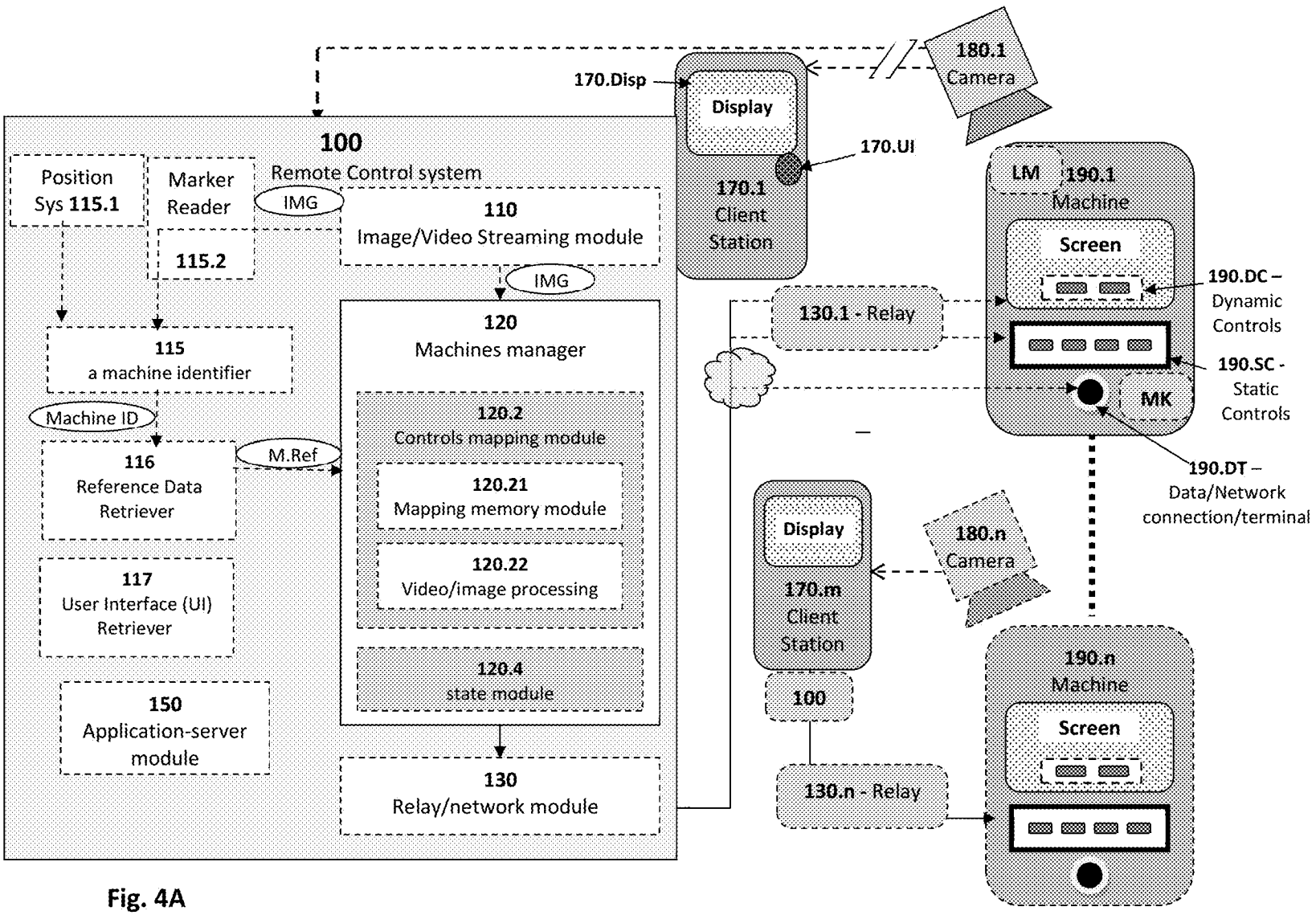
FIG. 4A is a block diagram illustrating a machine's remote control system 100 configured and operable according to an embodiment of the present invention; similar reference numerals as in FIGS. 1 to 3B above, are also used in FIG. 4A to designate the similar module, and the description of said elements with respect to FIGS. 1 to 3B may optionally also apply with respect to similarly referenced modules/elements of the system of FIG. 4A according to context.

Reference is made together to FIGS. 1 and 4A illustrating two embodiments of systems 100 for remote control of machines 190 according to the present invention. The machines 190 may generally be gaming machines of other machines, such as ATMs, industrial machines, household machines, computerized systems, or any other machine/system, having user interface (UI) controls, 190.DC or 190.SC which may include for instance static controls 190.SC such as buttons or handles or dynamic controls 190.DC, such as controls of a touch screen, which are, or can be made, visible/accessible to users of the machine. The systems 100 allow remote control of machines 190 via a user's client station 170 which includes a display 170.Disp and a user interface such as buttons or touchscreen, facilitating user interaction with the content shown on the display 170.Disp. The user's client station 170 may be for example a mobile device or a computerized system.

The remote control of the machines 190 according to the technique of the present invention is achieved by displaying an imagery/video of the machine to be controlled, e.g. 190.1 on the display 170.Disp of the user's client station, e.g. 170.1, designated for controlling that machine, such that at least some of the controls 190.DC or 190.SC of the machine 190.1 are made visible to the user of the respective client station via the display 170.Disp thereof, and made accessible to the user via the user interface 170.UI of the client station 170.1.

In some implementations the imager e.g. 180.1 which is used for capturing the machine 190.1 which is to be controlled by the client station 170.1, is remote from (e.g. not directly related to) not-related the client station 170.1, and may be for example a camera 180.1 located near the respective machine 190.1. For example, the camera may be a camera that is fixedly located near the machine 190.1 for capturing imagery thereof. In such implementations the streaming/communicating of the imagery/video of the machine 190.1 from the camera 180.1 to the remote from client station 170.1 may be performed over a communication link typically via network communication such as the internet.

Alternatively, or additionally, in some implementations the imager e.g. 180.1 which is used for capturing the machine 190.1, is part of, or directly connected to the client station 170.1, for example in cases where the client station 170.1 is a mobile device of the user. In such cases, the mobile device may be located near the respective machine 190.1, and the camera 180.1 by which the machine 190.1 is captured, may be the camera part of the mobile device (e.g. for example a user may decide to remotely control an ATM machine in his vicinity without touching the ATM machine itself, but instead using his mobile device 170.1 to control the machine. In such embodiments streaming of the imagery/video of the machine 190.1 should be understood as internal/local streaming/communication (e.g. via direct wired/wireless connection) internal to the client station or between connected parts thereof.

Once displaying at least part of the imagery of the captured machine 190.1 at the display 170.Disp of the client station 170.1 of the user, the system 100, e.g. a User Interface (UI) Retriever module 117 thereof, operates for receiving an input data from the user, via the user interface 170.UI of the client station 170.1, and identifies the input data indicative of interactions of the user with one or more regions in the displayed imagery of the machine 170.1, at which respective one or more of the controls 190.DC and/or 190.SC of the machine 190.1 appear, and operates for activating the machine 190.1 based on the input data (i.e. based on the interactions of the user with the regions of the display 170.Disp, at which the controls 190.DC or 190.SC of the machine 190.1 appear). The User Interface (UI) Retriever module 117 may be for example connected/or connectable locally or remotely to the operation logic processor/software of the client's station 170.1 and may be adapted to obtain data indicative of user interactions with the imagery IMG displayed on the display 170.Disp.

For that matter the system 100 actually maps the user's interaction (via the UI 170.UI) with the display 170.Disp of the client station, to intended user actions on the actual controls 190.DC and/or 190.SC of the machine. Therefore, the system 100 includes a machines' manager 120 that is adapted for processing the input data for associating the respective one or more controls of the machine, with the one or more respective regions of the imagery, with which the user interacted, and thereby map the user interactions to actions to be carried out on one or more of the respective controls 190.DC and/or 190.SC of the machine. Accordingly, the machines manager 120 determines certain operational instructions for activating the machine 190.1 in accordance with the user interactions with the appearance of the one or more respective controls in the imagery.

Reference is made together to FIGS. 1 and 2 respectively illustrating a block diagram of the system 100 configured and operable according to an embodiment of the present invention, and a flow chart 200 of the method operable according to an embodiment of the present invention. In the following description system 100 and method 200 are described together, yet it should be understood that in some embodiments of the present invention method 200 may be implemented by systems having somewhat different configuration than that presented in the embodiment of system 100, and conversely, the system 100 may implement a method somewhat different from the method 200 presented herein.

System 100 is an example of an online gaming system exploiting the remote-control technique of the present invention. It should be understood, and would readily be appreciated by those versed in the art, that although in the present instance remote control of gaming machines is exemplified, the technique of the present invention, as illustrated in this embodiment, is not limited to remote control of gaming machines and may be embodied for controlling any other type of machines. Accordingly, the term gaming machine should be understood to be used herein as of example, and encompasses also other machines/or system's.

In this none-limiting example, the system 100 is configured to obtain a video/imagery of one or more machine (e.g. gaming machines) 190.1 to 190.*n* and for streaming the video for display at one or more client stations (users) 170.1 to 170.*m*. The imagery may be obtained from imager(s) 180.1 to 180.*n* that is/are located/mounted (e.g. fixed) near the respective machines, or from movable imager(s) 180.1 to 180.*n*, for example from imagers associated with, or being part of, the users' client station(s) 170.1 to 170.*m* (e.g. in case the client station is a mobile device of the user). In the following, where possible the term gaming machine should be understood as referring generally to any machine, be it an actual gaming machine or any other type of machine (computerized decide or medical or industrial or household machine/equipment), having dynamic or static control(s).

In response to providing a video stream of a gaming machine 190.*i* to a client station 170.*k*, the system 100 may be adapted for receiving from the client station 170.*k* input data indicative of interaction(s) of a user of the client station 170.*k* with the gaming machine 190.*i* presented in the video. For example, the input data may include data indicative of the user's interaction with controls (e.g. buttons/touch screen) of the gaming machine 190.*i* appearing in the video of the gaming machine displayed at its client station 170.*k*. Based on this input data, the system 100 operates/activates the gaming machine 190.*i*. Accordingly, the user can operate and play the gaming machine 190.*i* on-line from a remote location of its client station 170.*k*.

In the present embodiment, the system 100 includes a video streaming module 110, a machines manager module 120, and a relay module 130. The video streaming module 110 is connectable to one or more cameras 180.1-180.*n*, which are respectively arranged to capture videos of one or more gaming machines 190.1-190.*n*. The machines manager module 120 is configured and operable for receiving/obtaining and processing the input data obtained from one or more of the client stations 170.1-170.*m* that are connected to the system 100, and for determining/generating operational instructions (e.g. instructions formed as analogue signals and/or digital data) for accordingly operating such one or more gaming machines. The relay module 130 is connectable to the gaming machines 190.1-190.*n* and is adapted for utilizing the operational instructions to operate the gaming machines with which the client stations' users interacted and to thereby enable remote operation of the gaming machines 190.1-190.*n*.

In some embodiments of the present invention, the method 200 for conducting remote online gaming on actual gaming machines includes operations 210 to 230 as follows: operation 210 for providing a video of at least one gaming machine (e.g. from camera 180.*i*) and streaming the video (e.g. by video streaming module 110) for display at a client station (e.g. 170.*k*) of a user. Operation 215 includes receiving input data from the client station 170.*k*, the input data including data indicative of the user's interaction with controls of a gaming machine 190.*i* appearing in the video presented at the client station. Operation 220 is performed based on the input data received from a user of a client station (e.g. 170.*k*) in response to the video stream displayed thereto. The input data received from the client station 170.*k* is used for controlling and/or managing the operation of the gaming machine 190.*i*. The input data includes data indicative of the user's interaction with controls of the gaming machine which appears in the video displayed thereto by the client station. Operation 220 includes processing such data to yield/generate operational instructions (e.g. in the form of digital data and/or analogue signals) usable for operating the gaming machines according to the user's integrations with the video thereof at the client station(s). The processing of 220 may be performed by the machines manager module 120, which may include a processor/micro-processor and a memory (not specifically shown in FIG. 1) that are operable for storing and/or executing computer readable instructions for carrying out operation 220. The computer readable instructions may be hard- and/or soft coded and may include several sets of computer readable instructions for each type of gaming machine connectable to the system 100. In some cases, the machines manager module 120 may be customizable for various types of machines, and may be configured and operable for custom installation of computer readable instructions for various machine types. Operation 230 includes utilizing the operational instructions obtained in 220 for operation/activating the respective gaming machines according to the input data from client stations' users. Operation 230 may for example be performed by the relay module 230.

Typically, the video streaming module 110 is connectable to the cameras 180.1-180.*n* and is operable in accordance with operation 220 of method 200 for receiving videos of one or more of the machines 190.1-190.*n* from one or more of the cameras 180.1-180.*n*, and streaming the videos via a network to one or more remote client station(s) 170.1 to 170.*m*. To this end, selection of a gaming machine video to be streamed to a particular client station in 170.*k* may be indicated/included in the input data received from the client station 170.*k*. and the video streaming module 110 may be adapted to accordingly generate respective video streams of the videos of the requested gaming machines, and communicates the video streams to the respective client stations (e.g. typically via a network such as the Internet). The video streaming module 110 may include/utilize a processor/micro-processor and a memory (not specifically shown in the figure) for receiving and processing videos from the cameras **180.1-180.*n*, identifying which video should be transmitted to which client station 170.1-170.*m***, and streaming the video thereto, for example by dividing the video data into packets, possibly also compressing them, and transmitting them utilizing a suitable protocol (e.g. UDP) via the network.

In some embodiments of the present invention, a user of a client station may select any gaming machine he would like to watch and/or play (e.g. regardless of whether the gaming machine is being played/occupied on/off-line or not). In other embodiments a user may be allowed to watch and/or play only those gaming machines whose status is marked as on-line status (designating that the machine can be played on-line). In yet other embodiments the user may be allowed to watch and/or play only those gaming machines which are non-occupied and whose status is marked as on-line status (namely only the machines with which the user may engage in a game). To this end, in some cases the video streaming module 110, may be configured and operable to obtain information regarding the gaming machines' statuses (e.g. on-line/offline statuses and/or occupied/non-occupied statuses) and/or information regarding which videos to transmit to the client stations from the machines manager module 120. For example, the machines manager module 120 may be operable for allocating the online/offline statuses to the gaming machines associated therewith. The on-line and/or off-line statuses may be determined based on definitions which may be set/inputted to the system by an operator of the specific casino (e.g. by the casino floor manager), and/or it may be determined by the machines manager module 120, based on the game states of the gaming machines (as may be obtained from the state module, and/or as may be determined form the relay devices **130.*i* of the relay module 130). Utilizing this information, and possibly also utilizing input data from the client station (s)/user(s), the machines manager module 120 may provide the video streaming module 110 with instructions/information indicative of which gaming machine video should be streamed to each of the client stations. Alternatively or additionally, the video streaming module 110 may be adapted for generating the video streams and not transmitting them directly to the client stations, but transmitting them indirectly (e.g. by providing the video streams to another module, such as the machines manager module 120 and/or an optional application server module 150** which has logic functionality for determining which video streams should be transmitted to the client stations).

The machines manager module 120 is configured and operable for managing the remote activation/operation of the gaming machines **190.1-190.*n* by the client stations 170.1-170.*m* that are connected to the system 100 via the network. To this end the machines manager module 120 is adapted to obtain (receive directly/indirectly from the client stations) input data indicative of the interactions of the client stations' users with the controls of the gaming machines 190.1-190.*n* that are respectively appearing in the videos/video-streams of the gaming machines 190.1-190.*n* which are displayed at the client stations 170.1-170.*m*. More particularly, according to some embodiments of the invention the input data obtained from a client station 170.*k*** includes data indicative of the interaction of the client station's user with one or more regions in the video displayed by that client station.

As noted above, the machines manager module 120 operates in accordance with method operation 220 for processing the input data received from the client station to determine the operational instructions for the gaming machine. According to some embodiments of the invention, the data indicative of the user's interactions with the machine controls (which is included in the input data) includes, or is formed as data indicative of the user interactions with one or more regions of the video that is displayed at the client station of the user. For example, it may include coordinates of a computer mouse position (e.g. when clicking/double-clicking/hovering with the mouse), and/or coordinate of a finger touch/hover on a touch screen of the client station. Accordingly, in some cases in method operation 220, the machines manager module 120 may process the input data by mapping the regions of the video to respective controls of the gaming machine appearing in the video. As a result of the mapping, the gaming machines manager module 120 associates the user interactions with activation/operation of the respective machine's controls.

In some embodiments of the invention the mapping in operation 220 is performed by carrying out operation 220.2 for providing mapping data associating controls of the gaming machine with the respective regions of the video. This operation may be performed for example by a controls mapping module 120.2, which is illustrated in FIG. 1 as an optional part of the machines' manager module 120. The mapping data may include predetermined data stored in a memory (e.g. in mapping memory module 120.21 of the machines manager module 120), and/or it may be data that is obtained from a video processing module 120.22 that is configured and operable for processing one or more frames of the video (e.g. utilizing by pattern recognition techniques and/or by other techniques) to identify the controls of the gaming machine in the video/frames and determine the regions/locations at which the controls are presented in the video. In this way an association/mapping between the user's interactions with the video and its intended actions on the controls of the gaming machine may be obtained. Accordingly, the controls mapping module provides for associating the user interactions with regions of the video with the activation of respective controls of the gaming machine.

It should be noted that in some cases/embodiments of the present invention, the gaming machines **190.1-190.*n* connected to the system may include only static controls 190.SC (e.g. which may constitute physical peripherals, such as push-buttons and/or joystick of the machine, which may be furnished on a cabinet of the machine). In such embodiments, the control mapping data stored in the memory 120.21 of controls mapping module 120.2 may include static/predetermined data associating the location of the physical peripherals of the gaming machine with their location in the video. As will be further described below, this data may be provided during an optional calibration operation 205, which may be performed after/during setting up the positions and orientations of the cameras 180.1-180.*n* with respect to their associated gaming machines 190.1-190.*n***.

Alternatively or additionally, in some cases, the controls of the machines **190.1-190.*n* may include dynamic controls 190.DC (namely controls which may be displayed dynamically on a screen(s), such as touch screen(s) of the gaming machine(s) 190.1-190.*n* in accordance with the state of a game played/executed thereby). In such cases, the control mapping data stored in the memory 120.21, may include for each gaming machine, one or more control-maps (also referred to below as dynamic control maps), such that each control-map is associated with a certain state/status of the gaming machine and includes data associating regions of the video with at least the dynamic controls 190.DC dynamically appearing in that state/status controls. The association of the static controls 190.SC of a certain gaming machine with the regions of the video of the gaming machine may be stored in a different control map (e.g. static control map), and/or stored together with the dynamic controls 190**.DC in the dynamic control maps.

Thus, the control mapping data may include association/mapping data associating regions of the video with different controls appearing thereat at different states respectively, and the controls mapping module 120.2 may be configured and operable for obtaining data indicative of a current state of a gaming machine played by a user and for utilizing this data for selecting a corresponding controls-map (dynamic or static) to be used for determining the operational instruction for the gaming machine. Data indicative of the current game state may be obtained from a game state module 120.4. The state module 120.4, which is described in more detail below, may optionally be included/associated with the machines manager module 120. Providing the suitable controls-map, the machines manager module 120 may be adapted to utilize it for processing the data indicative of the user interaction with one or more regions of the video for determining operational instructions for activating dynamic and/or static controls of a gaming machine 190.*i* played by the user.

In this connection with the calibration operation 205 indicated above, it should be noted that in some embodiments of the present invention the system 100 includes a calibration module 105 that is configured and operable for receiving/obtaining and storing calibration instructions/data to calibrate the system based on the types of gaming machines connected/associated with the system, and/or in accordance with positioning of the video-cameras which are associated with the gaming machines for capturing their video. In implementing calibration operation 205, the calibration module 140 may obtain calibration instructions including at least one of the following:

(1) The calibration instructions may include mapping data associating the controls of a gaming machine with their appearance/location in a respective video of the gaming machine, and possibly with a state of the gaming machine (in case of dynamic controls). For example, the mapping data may include a lookup table (LUT) associating one or more of the regions in a video of a gaming machine with respective controls of the gaming machine, and possibly also with a certain state/game state of the gaming machine.

(2) The calibration instructions may include computer readable code for generating operational instructions for operating one or more machine types.

The calibration module 140 may for example include a data input terminal (not specifically shown in the figure; e.g. data/network interface and/or user interface) for receiving the mapping data and/or the computer readable code for the machine types. The mapping data may include data associating static controls 190.SC for the gaming machine with their static/fixed locations/regions in the video, and/or it may include data associating the locations of dynamic control 190.DC in the video with particular states of the gaming machines. The computer readable code may include computer executable instructions for processing certain types of user interactions with the regions of the video of a gaming machine (e.g.) with operational instructions to be activated-by/relayed-to the gaming machine. Thus, by utilizing the mapping data, the machines manager module 120 may map the regions of the video, with which the user interacted, to respective controls of the gaming machine, and, utilizing the computer readable code associated with the type of the gaming machine, the machines manager module 120 may determine how the respective controls should be operated and also determine the operational instructions required for operating these controls by the relay module 130. In other words, the machines manager module 120 may utilize the calibration instructions to process the input data received from a user in relation to a gaming machine, to accordingly determine the operational instructions for operation of the gaming machine. Accordingly, in some embodiments of the present invention system 100 may be configurable for various types of gaming machines and may be implemented as a calibrate-able system allowing addition and/or subtraction of connections to gaming machines of different types and numbers.

As noted above, in some embodiments the controls mapping module comprises a video processing module 120.22 that is adapted to process one or more frames of said video to recognize controls of the machine appearing in the regions of the video, with which the user's interacts. Also here, the controls may include dynamic and/or static controls. The video processing module 120.22 may utilize reference/image data indicative of the controls appearance (e.g. a model whose data may be stored the memory 120.21), for processing the video and recognizing the appearance of one or more of the controls therein, and for determining the locations of the controls in the video. In some cases, in order to reduce the computational overhead, pattern recognition techniques or other video processing techniques may be applied only to the regions in the video with which the user interacts (e.g. as indicated in the input data). Accordingly, automatic recognition of the appearance of controls in these regions may be performed quickly and with moderate computational resources. As will be appreciated by those versed in the art of video processing, there are various known video processing and/or pattern recognition techniques which may be used/employed by the present invention for automatically identifying objects such as the controls of a gaming machine, in the video of the gaming machine. In some embodiments of the present invention, the controls mapping module 120.2 utilizes the video processing module 120.4, and optionally also utilizes data indicative of the video region(s) with which the user has interacted, to determine the operational instructions for activating controls of the gaming machine.

Operation 230 of method 200 is conducted upon determining the operational instructions for a gaming machine 190.*i*. The operational instructions, which may be digital/analogue signals/data, are used for operating the respective gaming machine 190.*i* according to the user's interaction with the controls of the gaming machine 190.*i*, which appears in the video. As noted above, the gaming machine 190.*i* is typically operated by a relay module 130 that is adapted for connecting to the gaming machines 190.1-190.*m* and is configured and operable for receiving the operational instructions from the machines manager module 120 and operating them accordingly.

In some embodiments of the present invention the relay module 130 actually includes one or more relay devices 130.1 to 130.*n*. For example each relay device 130.*i* may be associated with a respective gaming machine 190.*i* and may be configured and operable for operating the controls of the respective gaming machine 190.*i* based on the operational instructions that are associated with that gaming machine 190.*i*.

In some embodiments of the present invention, the relay module 130, and/or the relay devices 130.1 to 130.*n* thereof, are specifically configured and operable for connecting to electrical connections associated with the controls of the gaming machine 190.*i*. The controls include for example physical/static controls 190.SC such as buttons, joystick, gesture controls (e.g. movement capturing camera) and/or other physical control elements which may be located/mounted on a casing/cabinet of the gaming machine. Alternatively or additionally, the controls may include dynamic controls 190.DC, which may be dynamically displayed, when needed, on a screen/touch-screen of the gaming machine 190.*i*, in accordance with the state of the game. The physical/static control elements 190.SC and/or the screen, on which the dynamic controls 190.DC may be displayed, typically constitute and/or are part of the peripherals of the gaming machine 190.*i*. Thus, a relay device 130.*i* for the gaming machine 190.*i* may be configured and operable for operating its respective gaming machine 190.*i* by relaying the operational instructions to electrical connections of one or more of the peripherals of the gaming machines 190.*i*, which are associated with the gaming machine's 190.*i* controls. By relaying the operational instructions to the gaming machine in this way (e.g. via the electrical circuits of its peripherals) the system 100 does not interfere, and does not need to be implemented as a part of the gaming machine's logic (software or hardware of the gaming machine). Accordingly reliability and authenticity of the gaming machine's operation is preserved, and the system 100 can be implemented as a plug-in to the gaming machines.

As noted above, in certain embodiments of the present invention, the system 100 is configured for connecting to and operating gaming machines 190.1-190.*n* of various/different types. In such cases, the respective relay devices 130.1-130.*n*, which are connected to the gaming machines 190.1-190.*n*, may each be specifically adapted for operating its respective gaming machine. For example, as different gaming machines may have different control peripherals (e.g. a certain gaming machine 190.*i* may be equipped with a joystick, and/or with a touch-screen and/or with different numbers of buttons and/or with gesture capturing controls), accordingly the respective relay device 130.*i* of the gaming machine may be configured and operable for connecting to the circuits associated with the specific peripherals of its respective gaming machine 190.*i* and adapted for relaying the operational instructions provided by the machines manager module 120 to these circuits, seamlessly, as if these operational instructions are actually manifested by a player operating the peripherals of the gaming machine 190.*i*.

To this end, the machines manager module 120, may be adapted for operating each gaming machine connected thereto, in accordance with the type of the gaming machine. The mapping data for each gaming machine associates the controls of the gaming machine with their appearance/location in the video of the gaming machine. The machines manager module 120 may also utilize, for each type of machine, a computer readable code for processing the input data received from a client station's user remotely playing a machine of a certain type, to convert/determine from that input data, based on the machine type, the operational instructions for operating the machine of that type. In turn, the relay receives the operational instructions for operating the machine and relays them to the appropriate circuits of the machine's peripherals.

As also noted above, the operational instructions provided by the machine's manager module 120 may be in the form of analogue signals and/or digital data.

Accordingly the relay devices 130.1-130.*n* may include analogue and/or digital circuits. For example, the machines manager module 120 may include a digital processing means for generating a digital representation of the operational instructions. The relay device may include a controller/micro-processor and/or a digital to analogue convertor for processing the digital representation of the operational instructions to convert them, when needed, to analogue signals which are to be relayed to the peripherals of the machine. In some cases, where the peripherals or some of them are digital, such conversion of the operational instructions to analogue signals may not be required.

According to some embodiments of the present invention, one or more of the gaming machines may be equipped with a data terminal through which certain aspects of a game played on the machine may be controlled/adjusted and/or data related to the game state, or in general the state of the gaming machine, may be obtained. In some cases operation 220 also includes communicating game state data with a data terminal of a gaming machine. For example, in some embodiments of the present invention the machines manager module 120 includes a state module 120.4 that is connectable to data terminals of the gaming machines and adapted for communicating one or more of the following game-state data pieces:

(a) Communicating to and/or from the gaming machine game-state data indicative of an off-line state and/or on-line state of the gaming machine of the gaming machine. An off-line state indicates that the gaming machine is not available for on-line games by the client stations (although in some cases client stations may be allowed to view a video of the gaming machine). For example, in some cases the gaming machine may be locally occupied/used by a gamer, and accordingly, it may provide the game state module 120.4 with data indicating that it is currently in-use. In turn, the gaming machines manager module 120 may determine that it is being used off-line (e.g. in cases where it is not being used by on-line client stations). In some cases, on-line/offline states of the gaming machines may be controlled via the game state module 120.4, for making one or more gaming machines available for on-line use, off-line use, for both, or for neither of these uses. For example, this feature of the invention may allow an operator of the gaming machines to manage and control the use of the gaming machines (e.g. allocating some machines for local use (i.e. off-line use) and others for remote use (i.e. on-line use). The gaming machines on-/off-line states may also be used for generating suitable operational instructions for the relay devices 130.*i* of the relay modules, for example for blocking operation of the gaming machine 190.*i* via its local controls (e.g. in an on-line state of the gaming machine 190.*i*).

(b) Obtaining data indicative of game initiated state or game terminated state from the gaming machine. These game state data pieces may provide the gaming machines manager module 120 with the ability to monitor the operation and use of the gaming machines, to ensure proper operation thereof and to identify problems/malfunctions as they occur. For example, once a game is initiated, e.g. on-line by a client station's user, the gaming machines manager module 120 may generate suitable operational instructions for operating the gaming machine 190.*i* via its associated relay device 130.*i*. In such a case, a game initiated state may provide the gaming machines manager module 120 with feedback indicating that the game was actually initiated and that no malfunction occurred. At the end of the game, a game terminated indication may be obtained, allowing the gaming machines manager module 120 to monitor the game session of a client station with the gaming machine. It should be noted that in some case the relay module 130 and/or the game state module 120.4 and or their combination may be used by the gaming machines manager module 120 to determine/identify problem(s)/malfunction(s) in one or more of the gaming machines.

(c) In certain embodiments of the invention, gaming machines may be used for gambling of real/fake money on-line. In such cases, the game state module 120.4 may communicate game-state data indicative of the gambling amount to the gaming machine 190.*i*. The gaming amount may indicate the amount of money which is gambled on a game session conducted by the user of a client station with the gambling machine. In some cases these amount(s) are displayed on the screen of the gaming machine, such that the user of the remote client station may see them via the video of a gaming machine that is presented to him. At the end of a game, or a session of one or more games, the game state module 120.4 may be adapted to receive the gambling results data from the gaming machine, and/or bonus data. Gambling results data indicate the winnings (or losses) obtained during a game, and bonus data may for example indicate if the user is entitled to a bonus game or other benefits.

Thus, in view of the above, according to some embodiments of the present invention, the machines manager module 120 is adapted to operate the gaming machines 190.1-190.*n* without altering the logic/software of the machines, by utilizing the relay module 130 (e.g. relays 130.1-130.*n*) to connect to the electrical circuits of the machines' peripherals. Accordingly the machines may remain authentic and reliable, and a remote client user may trust/know their betting odds. Yet, in order to monitor the states of games played on the gaming machines, to place bets (gambling amounts) and monitor the gambling results, the system 100 (gaming machines manager module 120) utilizes standard data terminals of the gambling machines. In this manner the system 100 provides an efficient and trustable technique for conducting remote gaming on actual gaming machines.

As indicated above, input data that is provided from a user of client station 170.*k* for operating a gaming machine 190.*i* typically includes data indicative of one or more user interactions with regions of the video of the gaming machine 190.*i*. Yet, in some embodiments of the present invention, the input data may include additional data which is needed for selecting a gambling machine, and/or operating the gambling machine, and/or gambling/placing-a-bet on a game to be played on the gambling machine. In some cases, this type of additional data may not be obtained via the user's interaction with the video of the gaming machine. In such cases, system 100 may be configured and operable for providing the user/the client stations with a user interface including an area for presenting the video of the gaming machine and possibly including one or more additional user interface controls usable for entering such additional data. For example such user interface controls may include one or more of the following controls:

(a) One or more controls for selecting from a plurality of gaming machines at least one selected gaming machine to be video-displayed in the video area.

(b) One or more controls for placing bets on a game to be played on a selected gaming machine;

(c) One or more controls for providing billing data of the user for debiting and/or crediting the user based on his gambling results; and (d) Optionally, in certain cases not all of the controls of a gaming machine may be controlled by interacting with the video, and the user interface controls may include controls for operating the gaming machine, for conducting games.

In some embodiments of the present invention, the system 100 includes an application-server module 150 (e.g. a network server such as a web server and/or other server providing application interface to the client stations 170.1-170.*m* via a communication network). In this connection it should be understood that the client stations 170.1-170.*m* are typically computerized devices, such as PC's, laptops, tablet computers, mobile/smart phones, gaming consoles, TVs, and/or any other suitable device that may be connected to the network and that may be equipped/connected to a display and to one or more user interface input peripherals (e.g. keyboard, mouse, touch-screen, joystick, and/or gesture capturing peripherals) allowing the user to watch and control the gaming machine. The application-server module 150 is typically connectable to the video streaming module 110 and to the machines manager module 120. The application-server module 150 is adapted to communicate with the one or more client stations 170.1-170.*m*, which are connected to the system 100 via the network, for providing the one or more client stations with computer instructions indicative of a user interface for presenting a video of at least one of the gaming machines 190.*i*, and for receiving the user input data from one or more of the client stations 170.1-170.*m*. The computer instructions provided to a client station 170.*k* of a certain type may include for example computer readable code, such as a web page and/or a web/smart-phone application, that can be executed by that client station 170.*k* for displaying the video contents and possibly also additional controls of one or more of the gaming machines 190.1-190.*n*. Alternatively or additionally, the computer instructions may include data (e.g. content data) for presenting a video of one or more of the gaming machines 190.1-190.*n* and data for presenting user interface controls for selection of a gaming machine 190.*i* and/or for operation of a gaming machine 190.*i* by a user of the client station 170.*k*. Alternatively or additionally, the computer instructions may include data for presenting user interface controls allowing the user of the client station 170.*k* to place gambling bets, and to provide his billing information to the system 100. To this end, the user interface controls may include virtual controls (i.e. which are not presented and/or are not usable from the video of the gaming machine presented to the user). For example the virtual controls of the user interface may include controls for obtaining from the user information related to a navigation/selection of the gaming machine he would like to play, billing and/or gambling data input controls and/or other controls.

Thus according to some embodiments of the invention, the input data obtained from a client station 170.*k* in operation 215 of method 200 may include one or more of the following: (i) billing data indicative of billing account of a user of the client station 170.*k*, and (ii) gambling data indicative of amounts to be gambled-on in one of more game sessions conducted by the user. In operation 220.4 of method 200, the gaming machine 190.*i* may be provided with such gambling data, and the gambling results may be obtained from the gaming machine.

Optional operation 240 includes billing a user of a client station 170.*k* based on the results of his interaction with one or more of the gaming machines 190.1-190.*n*. For example, optionally, system 100 includes a billing module 140 that is connectable to, and adapted to obtain therefrom, a game result data indicative of the gambling results of one or more game sessions conducted by the user. The billing module 140 is configured and operable to utilize billing data indicative of a billing account of the user for billing that billing account based on the user's game results. To this end, in various embodiments of the system, the billing data indicative of one or more different types of billing accounts, and the billing module 140 may be adapted for debiting and/or crediting these billing accounts according to the game results. The billing accounts may for example be associated with different types of clearing houses and may include, a credit card account of the user, a PayPal account, and/or a local account of the user at a casino to which the gaming machines 190.1-190.*n* belong. The billing module 140 may be connectable to the respective clearing house with which the billing account is associated, for accordingly debiting and/or crediting the user. It is noted that in some embodiments conventional clearing houses are used and the billing module 140 may utilize conventional modules and interfaces for communicating with these clearing houses. Yet, a special embodiment relates to the case where the billing account may be an account of the user at the casino itself. In such cases a billing module 140 may include a specifically designed interface module adapted for communicating with the billing system of the casino.

Optionally, in some embodiments of the present invention the system 100 also includes a session manager module 160 configured and operable for monitoring the users/clients station's activity in the system. For example, the session manager module 160 may be connectable to the machines manager module 120 and may be adapted for receiving therefrom data indicative of the users/client-stations activities in the system and manage data records for the client stations and/or for the users for recording and tracking/monitoring sessions conducted by each client-station and/or user. Optionally, the session manager module 160 may also be connectable to the billing module/server 140, and may be adapted for recording the gambling results of the users and/for determining a gambling balance (e.g. a total amount of the winnings and losses of a user) for each of the client stations/users and/or for some of them. In this connection the session manager module 160 may be configured and operable for communicating the gambling balance to the billing module 140, for crediting/debiting the users thereby. Alternatively or additionally, the session manager module 160 may be configured and operable for providing statistics on the user's activity in the system 100, for identification of user habits, favorite gaming machines and/or other statistical information relating to the user's preferences. Such statistical data may be used for example for optimizing the system's operation (e.g. the types and numbers of gaming machines to be made available on-line), and/or it may be used for providing users with bonuses, such as bonus games, and/or with other benefits.

Yet alternatively or additionally, in some embodiments of the present invention the session manager module 160 monitors the operation of the gaming machines, which are connected to the system, and stores activity information/data indicative of the gaming machines that are connected to the system. For example, the session manager module 160 may be adapted to monitor the sessions of the users/clients-stations with the gaming machine(s), and receive (for example from the state module 120.4 and/or directly via data terminals of the gaming machine(s)) activity data indicative of the gaming machine state (e.g. gambled amounts win/loose states). The session manager module 160 may be adapted to store/record (e.g. in a database) the activity data. The recorded/stored activity data may for example include raw data describing the operations of the users on the gaming machines and/or the results of such operations (e.g. wining/loosing-amounts and/or -ratio and/or -number-of times). Alternatively or additionally the session manager module 160 may be adapted to process this data and store only statistical business-intelligence (BI) data indicative of the gaming machines operation and/or the users operations. In the following the recorder/stored data, be it raw or processed/statistical data is referred to as activity data. The activity data recorded by the session manager module 160 may be further analyzed to provide statistical information relating the gaming machines, for example to the rate/chances of winning in a gaming machine, and/or data indicative of the machine types which are favorable to a certain user. In some embodiments, such gaming activity data is acquired by application-server module 150 from the session manager module 160, which in turn utilize this data to present the user with recommendations on the gaming machines he might want to play and/or with the statistics of the gaming machines offered by the system, to thereby enhance the user's experience. To this end application-server module 150 may dynamically updates display portions on the client station with updated BI information which may be of interest to the user. Alternatively/or additionally, in certain embodiments the session manager module 160 may be associated with an interface allowing operators of the on-line system 100 to access and/or process/analyze the stored activity data to obtain valuable BI information relating to the gaming machines themselves (e.g. which gaming machines are most played by users; which gaming machines are most profitable; the average time durations user spends in each gaming machine), and/or BI data indicative of the users/clients of the system. Even more generally the session manager module 160 may use the stored activity information to analyze and possibly display information regarding a player's or a game machine's business parameters such as performance, life time value, utilization rate, win per unit Etc.

Figure 3A:
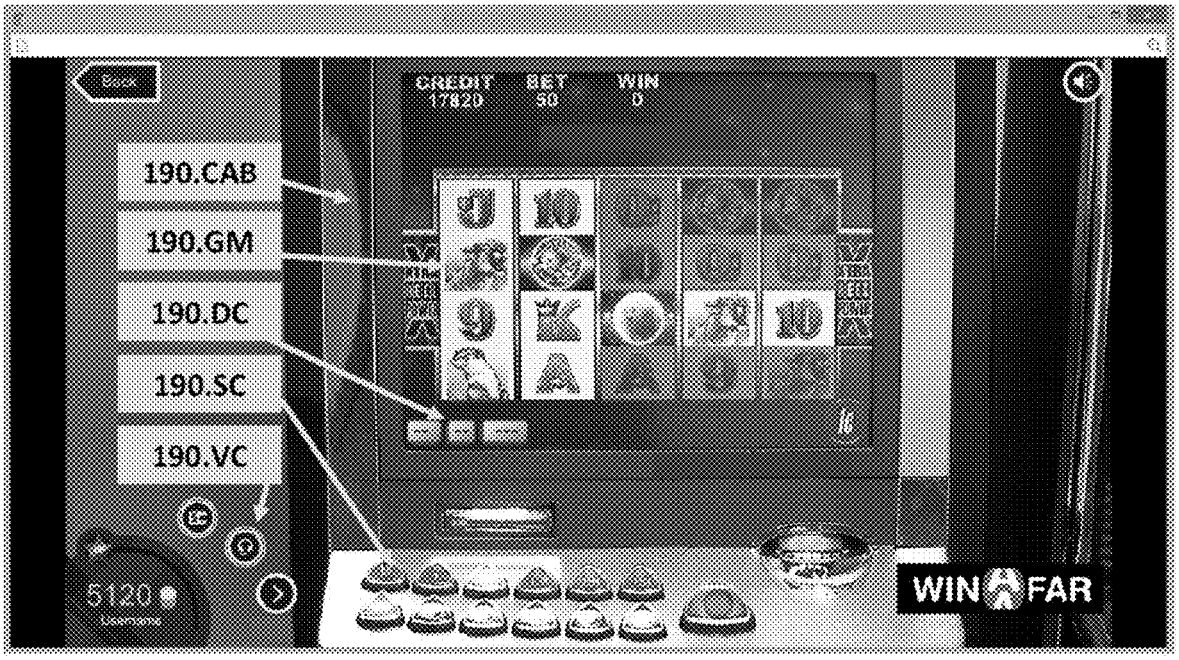
FIGS. 3A and 3B are two exemplary screen shots of a client station's display utilizing the technique of the present invention for presenting a gaming machine/cabinet to the user and receiving the user interactions therewith.
Figure 3B:
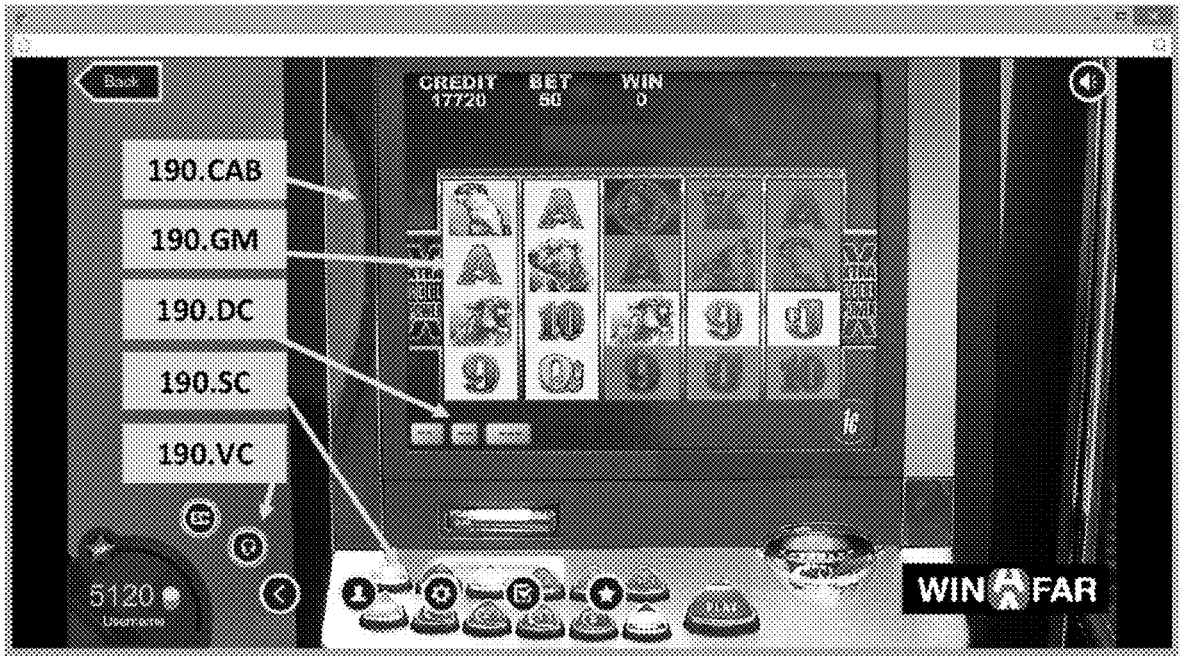

Referring now together to FIGS. 3A and 3B, illustrated in self-explanatory manner are two exemplary screen shots of a display of a client station, in which the technique of the present invention is used for presenting a gaming machine's cabinet to the user and for receiving the user interactions therewith. As shown in these figures, the gaming machine's cabinet 190.CAB, and the game 190.GM displayed thereby on its screen are presented in a video frame displayed at the client station. Also displayed to the user as part of the video, are the actual controls of the gaming machine 190, including the static controls 190.SC, which are located (e.g. fixedly-mounted) on the cabinet of the gaming machine, and dynamic controls 190.DC, which are presented on the screen of the gaming machine itself.

Also, in this example additional controls 190.VC are displayed/presented on the screen of the client station. The additional controls 190.VC are virtual controls, which are provide the client station's user with functionality that may not be available to him via interaction with the static/dynamic controls of the gaming machine itself. For example, the additional/virtual controls 190.VC may include navigation controls allowing the user to navigate between gaming machines, video and/or audio controls allowing the user to control the presentation and sounds provided to him at the client station, billing and gambling controls allowing the user to place bets and/or provide his billing account, and possibly also controls which are aimed at replacing some of the controls which actually exists in the cabinet of the gaming machine, to improve their usability by the user of the client station which uses the machine from remote. In this particular example, the virtual controls 190.VC, are presented as an overlay over the video of the gaming machine. In this regard, it should be noted that the location of the virtual controls in this case is selected/determined based on the mapping data associated with the gaming machine, such that the virtual controls 190.VC do not overlay static 190.SC and or dynamic 190.DC controls of the gaming machine itself, at states at which the operation of these static/dynamic controls may be needed. It should also be noted that alternatively or additionally, the virtual controls 190.VC, and/or some of them, may be presented at a separate region of the display of the client station. Also in some cases the presentation of certain of the virtual controls 190.VC may depend on the type of game/gaming cabinet being played, and/or on the game's state.

For example, FIG. 3A shows the gaming machine while it is being played by the user. Here some of the virtual controls 190.VC, which are not needed during the play, are hidden. However, in FIG. 3B, the gaming machine is shown in between plays, and additional virtual controls 190.VC are overplayed on the screen. In this case some of the virtual controls 190.VC also cover the locations of some of the static controls 190.SC of the gaming cabinet, which are not needed at that state of the gaming machine.

Reference is now made to FIG. 4A, which is a block diagram illustration of a system 100 for remote control of machines 190 via a user's client stations 170 according to another embodiment of the invention. As shown in the figure, the client station(s) 170 include a displace 170.Disp, and a user interface 170.UI facilitating user interaction with the display 170.Disp. The system 100 is configured and operable to obtain imagery IMG (e.g., an image(s) or a video) of at least one machine 190.1 having controls 190.DC and/or 190.SC and displaying at least part of said imagery IMG at the display 170.Disp of the user's client station, e.g. 170.1. The system 100 is further configured and operable for receiving input data from the user, via the user interface 170.UI of the client station 170.1, and activating the machine 190.1 based on the input data. The input data is indicative of interactions of the user with one or more regions in the imagery IMG of the machine 190.1 that is being displayed at the display 170.Disp of the client station 170.1 (e.g. including user's interactions with respective display regions at which one or more of the controls of the machine are displayed/appear).

The system 100 includes a machine manager module 120 that is adapted to process the user's input data, for associating the one or more respective regions of said imagery IMG with which the user interacted to respective one or more controls 190.DC and/or 190.SC of the machine 190.1 shown in the display 170.Disp, and thereby map the user interactions to one or more of said respective controls 190.DC and/or 190.SC, and determining certain operational instructions for activating the machine 190.1 in accordance with the user interactions with the display 170.Disp or imagery presented thereon.

It should be noted that in some implementations the system 100 may be at least partially implemented/incorporated with the client station 170.1. For instance, the client station may be a user's computerized or mobile device (e.g. a mobile phone, smartphone, laptop, PDA, tablet, mobile communication device of a user, etc.) including the display 170.Disp and the user interface 170.UI, as well as processing and networking capabilities (e.g. including memory, processor and network communication module), and the system may be at least partially implemented by computer readable instructions, as a mobile phone App or another executable, capable of implementing and carrying out some or all of the modules and operations of the system 100 as described herein. The system 100 may be connectable to imagers 180.1 for receiving therefrom imagery of machine(s) to be remotely controlled thereby, or the system 100 may include such imager 180.1.

As indicated above, according to some embodiments of the system 100, the machine manager 120 includes a controls' mapping module 120.2 (e.g. also referred to interchangeably herein as controls mapper), which is configured and operable to obtain reference mapping data indicative of association between the one or more regions/coordinates on the display 170.Disp with which the user had interacted, and the one or more respective controls of the machine appearing at these regions/coordinates on the display 170.Disp. To this end, the reference mapping data may be data stored locally with the system 100, or from the system 100 (e.g. stored at a server system 150 that is accessible over data communication such as network, to provide services to the system 100). In the latter case the system 100 may optionally include a reference data retriever module 116 that is configured and operable retrieving the reference mapping data from the remotely stored server data (e.g. retrieval for local storage and/or temporary in the mapping memory 120.21 which may be more easily accessible to the control's mapping module 120.2).

It should be noted that in some embodiments the input data to the system 100 (e.g. which is provided by the user interface 170.UI) includes not only the coordinates/regions of the user's interaction with the display 170.Disp, but also includes data indicative of the type of the user interaction's with those regions of the display (e.g. click, double-clear, hover, drag, or any other type of user interaction with the display which may be available by the client station 170). As indicated above, the controls of the machine may include for instance handles, push buttons, touch screen or other controls, which may in some cases yield different machine operations in response to different types of the user interactions. For instance, a handle control of the machine 190.1 presented on the client station's display 170.Disp may be responsive to the user dragging the displayed handle at the correct direction, but not responsive for pressing the handle (e.g. clicking the displayed handle). In another example a touch screen control of the machine 190.1 presented on the client station's display 170.Disp may be responsive to clicking or typing at certain coordinates of the display of the touch screen control on the client station's display 170.Disp, and responsive to dragging in other coordinates thereof.

To this end, at least in cases where there are various available types of user's interaction with appearance of the controls 190.SC or 190.DC of the machine 190 on the client station's display 170.Disp, the controls' mapping module 120.2 is operable to obtain the reference mapping data, such that it further includes data indicative of corresponding one or more operational instructions for activation of the one or more controls 190.SC or 190.DC of the machine 190.1 in response to the corresponding user interactions of the different available types of user interactions. Accordingly, when determining of the certain operational instructions to be sent to the machine 190.1 in response to a certain type of user interaction with a region of the display 170.Disp tat which a control of the machine 190.1 appears, the machines' manager 120 selects the certain operational instructions to be sent to the machine 190.1 from the corresponding one or more operational instructions in the reference data, also in accordance with the type of the user interaction with the region of the display at which the corresponding control appears.

In some embodiments, the system 100 may be preconfigured for controlling a certain particular machine, e.g. 190.1. However, generally in some embodiments the system 100 enables the user to remote control of various machines, e.g. 190.1 to 190.N shown in the figure. In the latter case, there is a need for the system 100 to identify the correct machine, which is presented on the display 170.Disp of the client station 170.1 and which the user attests to control. For such embodiments the system 100 may optionally include a machine identifier module 115 that is configured and operable for determining data indicative of an identity of the machine 190.1 that is captured by the imagery IMG of the user's client station 170.1. Accordingly, in such embodiments the reference data retriever module 116 or the control's mapping module 120.2 of the system 100 may be configured and operable for utilizing the data indicative of the identity of the machine, when retrieving/obtaining the reference mapping data, which is to be used by the mapping module 120.2, so that the reference data for the correct machine 190.1 is obtained.

Referring together to FIGS. 4B and 4C, these figures provide self-explanatory illustrations exemplifying the reference mapping data M-Ref for controlling a certain machine 190.1 according to two embodiments of the present invention. Columns C3 in Tables A and B in these figures show the part of the mapping data which is indicative of association between one or more regions and the one or more respective controls of the machine appearing thereat. In these particular non limiting examples both static and dynamic controls are considered (dynamic controls 190.DC are shown in rows R1 to R4 of the Tables A and B and static controls 190.SC in rows R5 to R7 of the Tables A and B). As will be appreciated by those versed in the art the machine may include only static or only dynamic controls and the reference data M-Ref will be provided accordingly. In these examples the static controls 190.SC are considered stateless and accordingly there is no need for determining their position or activation instructions based on the state of the machine. The static controls may be for example physical buttons/leavers/handles on the machine itself, e.g. on its cabinet. In these non-limiting examples, the dynamic controls 190.DC controls are state-dependent (not stateless) and may appear/disappear depending on the state of the machine 190.1. The dynamic controls may be for example buttons/textboxes or any other control which is presented on a touch screen of the machine 190.1 and may be presented only at certain one or more machine states.

Accordingly, Tables A and B exemplify two machine states: State-1 and State-2 in rows R1-R3 and R4 respectively at which different dynamic controls appear. It should be understood that the present invention is not limited to embodiments having state dependent controls and may be implemented with machines having stateless or state dependent controls or both and the mapping data will be provided accordingly. Columns C4 in Tables A and B in these figures show the part of the mapping data which is indicative of the operational instructions for activation of the machine 190.1 or its controls, in response to corresponding user interactions with the one or more regions of the client station's display 170.Disp at which the respective controls appear. In these non-limiting examples, some controls such as the Touch Screen Button C and the Physical Button A are associated with two or more types of possible user interaction therewith (e.g. click/left-click and right-click), in response to which different operational instructions are used for activation of the machine 190.1, as shown in rows R1-R2 and R5-R6 of the Tables A and B. It should be understood that the present invention is not limited to the case where some controls accept different user interactions and in some embodiments some or all of the machine controls may only receive one type of user interaction.

In these non-limiting examples, some controls such as the Touch Screen itself of the machine, may be considered as a control of the machine (see e.g. row R4 in the Tables A and B), whereby for example the cursor position/movement on the machine's screen may be used to control the machine. To this end, for machine(s) with touchscreen interface, the remote-control system 100 of the invention may define the "general" touchscreen of the machine as one of its controls (i.e. not only GUI controls such as button generated to the touch screen). This system 100 maps the position of the user interaction with the appearance general machine's touchscreen presented on the client stations to the actual cursor coordinates/movement on the touch screen of the actual machine. Those cursor coordinates represent dynamic locations of the machine actual touch screen allowing the user to interact with all parts of the touchscreen. This may be used to support dynamic button placement on the touchscreen as well as general control of the machine via the touch screen).

In the non-limiting examples of FIGS. 4B and 4C the reference mapping data is shown to include a lookup-table, e.g. Table A or B which map pixels or groups of pixels of the imagery IMG (e.g. pixel group defined by $(X'^1_A,Y'^1_A)$-$(X'^2_A, Y'^2_A)$) or of the model MDL (e.g. pixel group defined by $(X^1_A,Y^1_A)$-$(X^2_A,Y^2_A)$) to controls of the machine.

As indicated above, in some embodiments the camera/imager 180.1 which is used to capture the machine 190.1 displayed on the client station 170.1, may be fixedly located near the machine 190.1 (e.g. with fixed position and orientation near the machine, so that the reference data can pertain to substantially fixed coordinates of appearance of the machine and its controls in the image IMG provided from the camera). To this end, FIG. 4B pertains to the case where the image IMG, which is displayed on the display 170.Disp of the client station 170.1, is obtained from an imager 180.1 that is located at generally fixed or apriority-known position and orientation relative to the machine 190.1. In this case, as shown in Table A in the figure, the reference mapping data M-Ref may associate region in the image IMG itself (i.e. in the coordinate space (X',Y') of the image IMG) with the controls of the machine 190.1 appearing thereat. Here the tagged coordinates (X',Y') represent the coordinates of the client stations' display 170.Disp or of the image IMG presented thereby. Accordingly, a user interaction with regions (X',Y') on the image IMG or of the client stations' display 170.Disp can be directly mapped to interaction with the controls of the machine 190.1 based on the reference mapping data M-Ref.

Alternatively, or additionally, as also indicated above, in some embodiments the camera/imager 180.1 which is used to capture the machine 190.1 that is displayed on the client station 170.1, may not be fixedly located relative to the machine 190.1, e.g. and may optionally be mobile. For example, the camera 180.1 may be the camera of the client station 170.1, whereby the latter may be a mobile phone or other mobile device of the user. To this end, FIG. 4C pertains to the case where the image IMG, which is displayed on the display 170.Disp of the client station 170.1, is obtained from an imager 180.1 that is mobile relative to the machine or at least that its position and orientation relative to the machine 190.1 are not a priory known. In this case, as shown in FIG.

4C the reference mapping data M-Ref includes data indicative of a reference model MDL of the appearance of the machine 190.1, and reference map, e.g. columns C3 in Table B, associating one or more regions (X,Y) of the reference model MDL with one or more respective controls of the machine 190.1, which are located at these regions (X,Y) of the reference model MDL respectively (i.e. in the coordinate space (X,Y) of the reference model MDL). Here the non-tagged coordinates (X,Y) represent the coordinates of the reference model MDL. It should be understood that the reference model MDL may be two or three-dimensional model (2D or 3D), and accordingly the non-tagged coordinates of the model may be two dimensional (X,Y) or three dimensional (X,Y,Z). The reference map, e.g. columns C3 in Table B, maps the 2D or 3D coordinates of the model, (X,Y) or (X,Y,Z), to respective controls of the machine 190.1 modeled thereat. In this case, a user interaction with regions (X',Y') on the image IMG or of the client stations' display 170.Disp can be directly mapped to interaction with the controls of the machine 190.1 based on the reference mapping data M-Ref.

In this case, e.g. in embodiments where the camera/imager 180.1 is mobile relative to the machine 190.1, the reference mapping data M-Ref should be adjusted according to position and orientation of the camera/imager 180.1 relative to the machine 190.1 so as to conform the association/mapping (e.g. Col. C3 in Table B) in the reference mapping data M-Ref, such that it would reflect association between the one or more regions/coordinates of the image IMG on the display 170.Disp and the respective controls of the machine appearing thereat, in line with the position and orientation of the imager 180.1 of image IMG relative to the machine 190.1. Accordingly, in such embodiments in order to facilitate such adjustment of the mapping, the reference mapping data for the machine 190.1 may include the data indicative of a reference model MDL of the appearance of the identified machine 190.1, and the reference map Col. C3 in Table B associating one or more regions of the reference model with the one or more respective controls of the machine 190.1 which are located at these regions of the reference model respectively. In turn, the controls mapping module 120.2 may include the image/video processing module 120.22 which is configured and operable for processing at least the displayed part of the imagery IMG of the captured machine 190.1 against/with the reference model MDL, to determine a spatial registration (e.g. fitting) between the reference model and the displayed part of the imagery IMG of the captured machine 190.1 (e.g. by utilizing image/pattern recognition or the like). Accordingly, the controls mapping module 120.2 may configured and operable for processing the reference map based on that spatial registration to determine an actual map correctly associating the one or more regions of at least the displayed part of the imagery IMG of the captured machine 190.1 with the one or more respective controls (e.g. touch screen) of the machine 190.1 that appear at these regions of displayed part of the imagery while compensating for variations in the camera's position or orientation.

The machine manager 120 then utilizes the actual map to carry out the association between the respective one or more controls of the machine, and the corresponding operational instructions for activating them, with the one or more respective regions of the imagery at which the controls appear or with which the user interacted. Thereby enabling to correctly determine the certain operational instructions which are to be communicated to control the machine according to the user's interaction with the display. It is noted that in embodiments where the camera/imager 180.1 is fixedly located relative to the machine 190.1, the reference mapping data itself (e.g. Col. C3 in Table A of FIG. 4B) may present the actual mapping without a need for the above-described spatial registration process, since the camera and accordingly the image IMG of the machine on the display are statically located and oriented.

As indicated above, in some implementations, some controls of the machine 190.1 may be dynamic controls 190.DC whose appearance (e.g. on the machine itself) or whose operation, depend on the state of the machine (see e.g. states State-1 and State-2 in Tables A and B). Accordingly, for determining the operational instruction in such cases, in some embodiments of the invention the machine manager 120 includes a machine state module 124 that is capable of determining the state of the machine (see e.g. be it State-1 and State-2), so that according to the machine state, the correct operational instructions, may be selected from the reference data M-Ref, for activating the machine in response to a certain user interaction in response to user interaction. The machine state module 124 may be configured and operable to obtain the state of the machine by utilizing any one or more of various techniques. For instance, one technique would be to communicated with the machine 190.1 or with a server, e.g. 150, associated therewith, to obtain data indicative of the state of its operation. Alternatively, the machine state module 124 may be accessible to or of its screen, at various operational states/stages thereof, and may employ the video processing module 120.22 for comparing displayed image IMG of the machine 190.1 with its appearances at various states, as provided by the state-reference data, and thereby determine the current state of the machine (e.g. by determining the "best match" between the image IMG and the appearance of the machine at that state). Accordingly, the machine manager 120 can determine the correct operational instructions to be activated in response to the user interaction, based on the reference mapping data M-Ref and the current state of the machine 190.1, as displayed in the image IMG to the user.

Figure 4D:
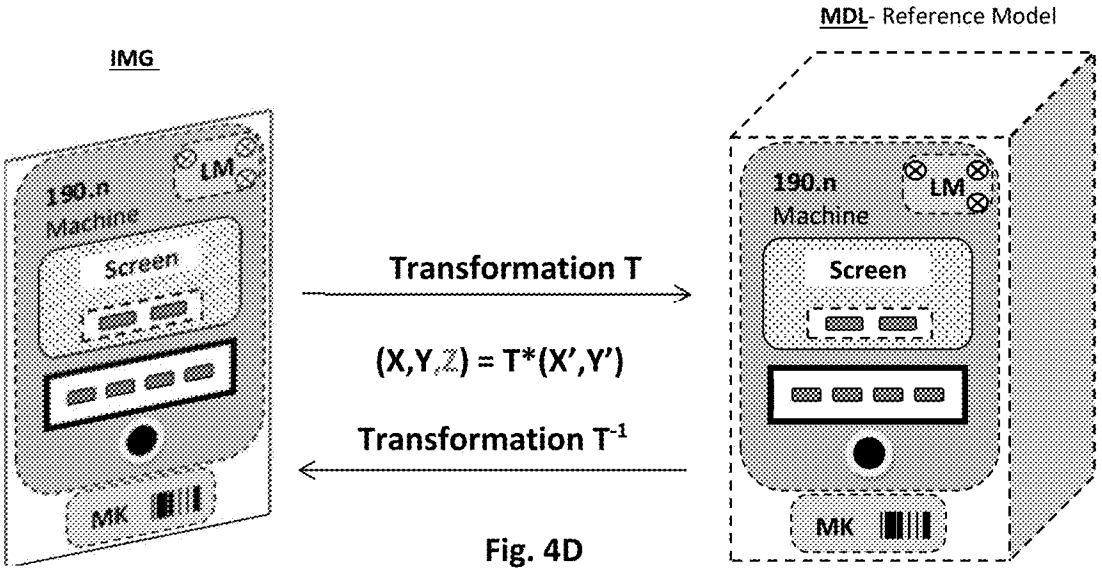
FIG. 4D schematically illustrates a transformation relating an image of machine to a reference model thereof.

Referring to FIG. 4D, a spatial registration on coordinate transformation T between the model MDL and the image IMG is exemplified for a case where the imager 180.1, which is used by the system 100 for capturing the machines 190.1, is mobile imager, resulting with the imagery of the machine 190.1 being captured from a non-predetermined (not fixed) position and orientation coordinates relative to the machine. In this case, as indicated above, in order to facilitate mapping of the user interactions with the display 170.Disp of the client station 170.1 to the controls 190.SC or 190.DC of the machine is a need to determine a spatial registration (e.g. FIT) between the reference model MDL of the machine provided in the reference mapping data M-Ref and the displayed part of the imagery IMG of the machine 190.1 from the position and orientation at which it was captured.

In order to achieve that, in some embodiments the reference model of the machine 190.1 includes one or more reference/alignment landmarks LM, that also appear on the machine 190.1. The landmarks LM, as exemplified in FIGS. 4C and 4D, may include a spatial arraignment of markings appearing on the machine, whose imaging can be indicative of the orientation and distance from which the image IMD of the machine is captured (e.g. as would generally be appreciated by those versed in the art, a spatial arrangement of three marks as simple as dots, e.g. which are not mutually coaligned, may be used to estimate a distance and orientation from which an image IMG thereof is captured. Accordingly, the image/video processing module 120.22 may be configured and operable to process at least the displayed part of the imagery IMG of the captured machine 190.1 to identify appearance of such landmarks LM therein, and determine a landmarks' spatial registration/transformation T between the imaged landmarks LM' and the landmarks LM of the machine 190.1 as appearing the reference model MDL. Then for example by processing the landmarks' spatial registration/transformation T, for example utilizing extrapolation and interpolation, the video processing 120.22 may determine the spatial registration/fit between the displayed part of the imagery IMG of the captured machine 190.1 (e.g. any point thereof) and the reference model MDL. Accordingly, based on that fit/transformation T, any interaction of the user with the controls of the machine appearing on the image IMG and displayed to him on the client station's display 170.Disp, can be correctly mapped to a respective control 190.SC or 190.DC of the machine 190.1, irrespectively of the position and/or orientation from which the displayed image IMG is captured.

To this end, it should be noted that in some implementations of the invention the reference model MDL of the machine 190.1 may include a reference image of at least a part of the machine 190.1. In such embodiments the image/video processing module may be configured and operable to apply image/pattern recognition determine the special registration between the reference model and the displayed part of the imagery of the captured machine 190.1. In this case the reference landmarks LM may be trivial arbitrary distinctive markings that appearing in both the model MDL and the captured image IMG of the machine (e.g. as opposed to designated landmarks placed on the machine for this purpose).

To this end, it should be noted that in some implementations of the invention, in determining the spatial registration/fit/transformation T between the model and the presented image IMG on the display, the image/video processing module carries out at least one or both of the following:

i. applies one or more spatial transformations T to the imagery IMG of the at least part of the machine 190.1, to obtain one or more transformed images, and determine the transformed image having a best fit with the reference model MDL and a corresponding spatial transformation T associated therewith. Accordingly, the spatial registration may be determined or represented by that corresponding spatial transformation T, since any region on the display with which the user interacts may be mapped to the correct position on the model based on that spatial transformation.

ii. (vice versa to i)—applies one or more spatial transformations to the reference model MDL to obtain one or more transformed models, and determine the transformed model having a best fit with the imagery IMG of the at least part of the machine and a corresponding spatial transformation $T^{-1}$ associated therewith (which is practically the inverse of the transformation T that would be obtained in (i) above.

Accordingly, both these cases the spatial registration between the model and the image may be determined based on the corresponding spatial transformation T or $T^{-1}$.

The spatial transformation T or $T^{-1}$ may include for example a combination of one or more of the following carried out with respect scaling or rotation of one of the image IMG or the reference model, towards the other one the reference model or the image IMG: tilt, rotate, warp, scale, perspective transformation, zoom-in and zoom-out. As indicated above the model MDL may be 2D or 3D model whereby the image IMG is generally 2D. Accordingly the transformations T or $T^{-1}$ may relate 2D coordinate space (X',Y') of the image IMG with 2D coordinate space (X,Y) of the model MDL or with 3D coordinate space (X,Y,Z) of the model MDL.

Alternatively, or additionally, as indicated above the registration between the image and the model may not necessarily be implemented via spatial transformation T, but may for instance be achieved via fitting processing conducted between the image and the model. As will be readily appreciated by those versed in the art, such fitting processing may be conducted utilizing various techniques, for example by optical/image fitting or pattern recognition.

To this end, in the following T is used to indicate the spatial registration between the model and the image, regardless if it is represented by a special transformation or by a fitting data which may include for example a lookup table associating regions/pixels or groups of pixels in the model MDL (such as the region/pixel group defined by $(X^1_A,Y^1_A)$-$(X^2_A,Y^2_A)$) with corresponding pixels or group of pixels in the image IMG (e.g. the region/pixel-group defined by $(X'^1_A,Y'^1_A)$-$(X'^2_A,Y'^2_A)$).

It should be noted that in some embodiments the imagery IMG of the machine 190.1 is video imagery, during which the imager 180.1 may move and accordingly the appearance of machine 190.1 in the image frames of the imagery/video IMG, may change. Accordingly, in such embodiments the image/video processing module may be adapted to track the spatial registration between the model MDL of the machine and the imagery IMG across a plurality of video frames. Indeed, special registration as described above may be conducted per each video frame independently, however such processing will be inefficient and computationally intensive. Thus, in some embodiments the image/video processing module may be adapted to track the spatial registration between the model MDL and the video frames by utilizing more efficient optical comparison techniques between video frames such as optical flow. Alternatively or additionally the tracking of the spatial registration may include utilizing inertial sensors (e.g. accelerometer or gyro) to monitor movements of the imager 180.1 utilize the movements for carrying out at least one of:

(a) update the spatial registration according to the monitored movements;

(b) stabilize the displayed imagery of the at least part of the machine shown on display based on said movements.

Thus, once the image/video processing module 120,22 determine the spatial registration T between said reference model MDL and the displayed part of the imagery IMG of the captured machine, the mapping module (mapper) 120.2 may utilize the spatial registration T map the one or more respective controls of the machine located at the respective spatial regions of the model MDL, as shown in column C3 in Table B to corresponding spatial regions of the displayed part of the imagery IMG of the captured machine at which the control appear, and thereby determine the actual mapping data as shown in columns C3 in Table A, which associates the respective spatial regions of the displayed part of the imagery IMG of the captured machine with corresponding operational instructions for activating the corresponding controls of the machine. For instance, the model mapping/registration T is a spatial transformation which when applied to designated locations in the reference model (e.g. column C3 in Table B) yields the actual mapping data (e.g. column C3 in Table A).

It should be noted that in some implementations the system 100 may include the reference mapping data M-Ref at an internal/associated memory storage thereof. Alternatively or additionally the reference mapping data may reside at one or more servers 150 remote from the system 100, and the system 100 may include a reference data retriever module 116 that is configured and operable to access the one or more servers for retrieval of the reference mapping data.

Thus, once determining the certain operational instructions to control the machine 190.1 (according to the user's interaction with the client station's display 170.Disp, the machine manager 120 operates for issuing activation communication for activating the machine based on these certain operational instructions. Generally, as indicated above, the certain operational instructions are communicated to the machine via a relay 130 module, which may be for instance a network communication module (e.g. a network card of a WIFI/LAN/WAN/Internet/BT or other communication network) that is capable of directly or indirectly accessing the machine 190.1 to which the operational instructions are directed for operation the machine accordingly to thereby enable remote operation of the machine 190.1 with which the user has interacted via the clients station's display 170.Disp.

In some embodiments, the relay module 130 may be directly connectable to any one or more of the machines **190.1-190.*n* to be controlled, e.g. to data/network connection thereof 190.DT, via the network such as the internet or local network. In such embodiments the relay module 130 may employ the suitable network protocol, or control API (so called Application Interface) of the respective machine 190.1, for operating the respective machine 190.1 according to the certain operational instructions determined by the machine manager 120. Alternatively or additionally, for example in cases where the machine does not expose any data/network connection 190.DT or control API, the relay module 130 may be indirectly connectable for controlling the machine 190.1 via an optional respective relay device 130.1 which is coupled to one or more of the controls 190.SC or 190.DC of the respective machine 190.1 which is to be controlled by system 100. For instance, the respective relay device 130.1 may be a component/circuit that is on the one had to communicated with the system 100 via its relay/network module 130, and is on the other hand coupled to one or more of the controls 190.SC or 190.DC of the machine 190.1 and capable of activating the, according to the operational instructions which are determined by the machine manager 120 and communicated thereto by the relay module 130 of system 100. Thus, the direct way of relaying the operational instructions to the respective machine 190.1 may be employed in cases where the respective machine 190.1 exposes the suitable network connection and suitable API enabling its control from afar over a network. The indirect way of relaying the operational instructions to the respective machine 190.1 may be employed in cases where the respective machine 190.1 does not expose the suitable API for its control from afar, and in such cases it may be controlled by operation its controls via relay device 130.1** that is connected thereto.

As indicated above, in some embodiments of the present invention, the system 100 includes a machine identifier module 115 that is capable of identify the correct machine, e.g. 190.1, which is to be controlled thereby (e.g. so that the relay/network module 130 can communicate the determined operational instructions to the correct network address, or to the relay device 130.1, of the correct machine 190.1, which is presented on the display 170.Disp of the client station 170.1. For that matter, the machine identifier module 115 needs to be able to determine the identity of the machine 190.1 that is captured by the imagery IMG presented on the user's client station 170.1.

In order to achieve that, in some embodiments the machine 190.1 is assumed to be presently in vicinity of the position of the respective imager 180.1 by which the imagery IMG of the machine 190.1 is supplied to the system 100. In such embodiments the machine identifier 115 may be associated with, or connectable to, a positioning module 115.1 such as a GPS other positioning module, which is capable of providing data indicative of a position of at least the imager 180.1 by which the imagery IMG of the respective machine 190.1 is captured (it is noted that in some cases the imager as well as possibly the system 100 may be both implemented with the client station of the user—which may be a smart mobile device/phone—so the position may actually be the position of the clients station). In such embodiments the machine identifier 115 may utilize the positioning data (which is assumed to be near the respective machine 190.1) to determine the identity of the machine 190.1 based on the position of the system/imager.

For instance, the machine identifier may utilize a machines reference data e.g. a lookup table (LUT) associating a plurality of machines with respective positions a thereof, and may determines the identity of the machine 190.1 based on proximity between the position of the machine 190.1 and the position of the system/imager as provided by the positioning module 115.1 (e.g. the machine closest to the position of the imager 180.1 may be determined as the correct machine 190.1 imaged thereby).

It should be noted that in the above non-limiting example, the position of the machine serves as a machine indicia/marker indicative of identity of the machine. The machines LUT thereby associates the machines identities with the respective machine indicia. However, in some implementations the machines indicia may be another element associated with the machine such as a visible marker (e.g. barcode or appearance) which is located/presented on the machine and indicative of its identity, or an invisible marker such as an RFID or NFC tags located near/with the machine.

Thus, in some embodiments the machine identifier 115 is connectable a marker reader 115.2 that is adapted to read an identification/marker MK associated with the machine 190.1. For example, the identification tag/marker MK may be a visible identification marker/indicia appearing on said machine (such as a barcode QR-code or a unique visible form of the appearance of the machine itself) and including at least one of In this case the marker reader 115.2 may include includes an image processor adapted to process an image of the machine (e.g. the image IMG provided by imager 180.1 or another image) to recognize the identification marker MK of the machine and thereby determine its identity. Alternatively or additionally, the identification marker may also be an invisible marker included with the machine 190.1 (such as an RFID tag, NFC, XRF tag or the like) and accordingly the marker reader 115.2 may include a suitable reading apparatus/utility for reading such invisible marker of the machine from a suitable proximity/distance between the system 100 and the machine 190.1.

It should be noted that in some embodiments the identification markers MK on the machines are directly indicative of the identities of the respective machines (e.g. the markers may encode the network address of the machine or any other parameters that enables the system 100 to access/communicate with the machine. Alternatively or additionally, in some implementations of the system 100, the machine identifier 115 utilizes machines' reference data (e.g., machines LUT associating a plurality of machines with respective identification markers and identities thereof) to determine the identity of the machine (e.g. based on machine of the identified marker with the machine markings in the machines reference data/LUT). The machines' reference data/LUT may for instance reside at a server 150 remote from the system 100 and the machine identifier 115 may be configured and operable to access this server to obtain the machines' reference data/LUT (e.g. possibly utilizing the reference data retriever module 116 to access the servers holding the machines LUT).

In some embodiments the system 100 is connected to or is at least partially implemented with an application-server model 150 which serves as server for machines' remote control. The modules 110, 120, 130, 115, 116, 117 of the system 100 may be entirely implemented on the client station 170.1 and the server 150 may serve for storing data repository indicative of the reference mapping data for the machines and/or for relaying the operations instructions from the system for activating the machine. Alternatively or additionally some or all of the modules 110, 120, 130, 115, 116, 117 of the system may be implemented on the server 150, and the system 100 may be adapted to acquire from the client station 170.1 data indicative of the user interaction with display 170.Disp, and operating at the server to operate the machine accordingly based on the technique described above.

For example, method 400 illustrated in the flow chart of FIG. 5 illustrates the operations of the technique of the present invention for remote control of machines. All or some of the following operations of method 400 may be performed by parts of the system 100 installed on either the client's station 170.1 of the server 150, or in combination:

- Operation 410 streaming/communicating the imagery (IMG) of the machine 190.1 to the client station's display 170.Disp for display thereon (e.g. operation 410 may be carried out by the above described optional image/video streaming module 110);
- Operation 415: (optional—in case of not a priory known machine) on the client station's display 170.Disp (e.g. operation 415 may be carried out by the above described by the optional machine identifier module 115);
- Operation 417: Receiving/obtaining the data indicative of the user's interaction with client station's display 170.Disp (e.g. the regions/coordinates (X',Y') of the interaction and the type of the interaction such as click, right-click, drag, hover, etc.); (e.g. operation 417 may be carried out by the above described by the optional UI retriever module 117);
- Operation 416: Receiving/obtaining the reference mapping data M-Ref indicative of the association between the one or more regions of the imagery IMG and one or more respective controls of the machine appearing thereat, and possibly also indicative of the operational instructions for activation of the machine in response to one or more types of the interactions the appearance of these controls in the image IMG displayed on the client station's display 170.Disp (e.g. operation 416 may be carried out by the optional reference data retriever module 116).
- Operation 422: using the obtained user interaction data and the obtained reference mapping data for determining/mapping the user interactions to the machine's controls with which the user had interacted on the image IMG of the machine displayed on the client station's display 170.Disp (e.g. operation 422 may be carried out by the above described controls mapping module 120.2);
- Optional operation 423: the mapping of the user interactions to the machine's controls in operation 422 includes the optional operation 423 carried out for determining the above-described spatial registration/transformation between the displayed image of the machine, IMG, and reference model MDL in order to determine the actual controls of the machine with which the user had interacted (operation 423 may be carried out by the above-described video/image processing module 120.22);
- Operation 424: using the type of the user interaction in the UI data (click, drag, etc.) the determined control of the machine with which the user had interacted, for determining the operational instructions which are to be issued for activating the machine 190.1 according to the user's interaction (e.g. operation 424 may be carried out by the above described machines manager module 120.2);
- Optional operation 425: the determining the operational instructions for activating the machine 190.1 includes the optional operation 425 for determining the state of the machine and thereby determining the dynamic controls 190.DC, which are presented in the image or the operation of the current operation of the machine's controls (Optional operation 425 may be carried out by the above-described state module 124);
- Operation 430: Relaying/communication the operational instructions for activating the machine 190.1 to the machine or its controls (by the relay/communication module 130, possibly via the server 150, or possibly via the relay devices/circuits 130.1 coupled to the machine 190.1 or to its controls 190.SC and/or 190.DC (operation 430 may be carried out by the above-described relay/communication module 130, and/or by the server 150 and/or by the relay device/circuit e.g. 130.1).

Thus, the system 100 of the present invention may be distributed between the client station 170.1 and a server 150, or may be fully located at the client station 170.1, or may be almost fully located at the 150 server 150, except for minimal application at the client station 170.1 for communication user interactions with the display to the server 150. Accordingly, all or some all or some of the above operations of the method 400 may be conducted at/by client station 170.1, and/or at/by a server system 150 communication with the client station. For example, the system may include an executable application suitable for execution by the client station, or an executable application suitable for execution by the server, and or a set of client-server application for respective execution by both. Accordingly, generally the client stations and/or the server include suitable processors and memories and network modules for conducting the above processing, memory storage and retrieval, as well as communications required for the above-described operations. It should be understood that the system 100 may be configured for facilitating remote control of one machine 190.1 or in the same way of a plurality of machines to 190.1-**190.*n* and for the same purpose may be furnished or connected with one or multiple client stations 170.1-170.*n*. In some implementations the system also includes the relay devices/circuits 130.1 to 130.*n* which are connected to the controls of the respective machines and capable of their control/manipulation. The relay devices/circuits 130.1 to 130.*n* may also themselves include network communication modules enabling them to communicate with the system 100 to execute the machines' operational instructions that are issued by the system 100**.

To this end, in some embodiments the system 100 is configured and operable for communicating (e.g. via a network module not shown) with an application-server 150 serving as a machines remote control server over a network to carry out the following:

(a) provide the server 150, with machine identification data indicative of the identity of the machine 190.1 captured by the imager 180.1 to receive, in response from the server 150, the data indicative of the reference mapping data of the identified machine 190.1;

(b) provide the server 150, with activation communication data indicative of certain operational instructions for activating the machine according to the user interaction with the control of the machine displayed at the coordinates of the display with which the user has interacted, based on the type of interaction of said user with the coordinates at which said control of the machine appears on said display.

In some embodiments the server 150 includes the machines reference data (e.g. machine LUT) associating a plurality of machines, e.g. 190.1 to 90.*n* with respective machine identification data thereof. The machine identification data may for instance include: (i) data indicative of a position of the machine 190.1; and/or (ii) data indicative of appearance of the machine 190.1; and data indicative of identification indicia (tagging/barcode) of the machine 190.1.

In response to the activation data, the server 150 may establish a communication with a communication module 190.DT associated with at least one of: (i) a controller of the machine, and (ii) a relay device 130.1 connected to the controls 190.SC or 190.DC of the machine 190.1, for providing thereto, the certain operational instructions for activating the machine. At least one of the (i) controller of the machine and the (ii) relay module connected machine, is configured to receive the operational instructions and activate the machine accordingly.

Thus, certain embodiments of the present invention are implemented as a machines remote control server 150 that is configured and operable for operating over a network to carry out the following:

(a) providing reference machine data to a client device 170.1 of a user by carrying out the following:

i) obtaining machine identification data indicative of the identity of a machine captured by an imager of the user;

ii) processing the identification data utilizing machines reference data (machine LUT), which is stored in memory associated with the server and includes data associating a plurality of machines with respective machine identification data thereof; and determining the identity of the machine 190.1;

iii) utilizing the identity of the machine 190.1 to search in a reference data storage for reference machine data associated with that machine, and including the reference mapping data for the controls of the machine.

iv) provide the reference mapping data for the controls of the machine data to the client device 170.1 of the user; and (b) activating the machine 190.1 based on the operational instructions from the client device of a user, by carrying out the following:

i) receiving, from the client device 170.1, activation communication data indicative of certain operational instructions for activating the machine 190.1 according to user's interaction with a control of the machine displayed at certain coordinates of a display 170.Disp of the client device 170.1 with which a user of said device had interacted, and at which that control of the machine appears 190.1;

ii) utilizing the identification data of the machine to determine, based on said machines reference data (machine LUT), communication parameters for communicating with that machine 190.1 directly 190.DT or via a relay device 130.1;

iii) utilizing the communication parameters for establishing of for communicating with the machine directly 190.DT or via the relay device 130.1, to provide the machine 190.1, or the relay device 130.1, with instructions for activating the machine 190.1 according to the user interaction (i.e. according to the certain operational instructions).

Typically, the above-described machines remote control server 150 includes the following modules:

a network communication module (not specifically shown—e.g. 130);

Reference data storage (not specifically shown) including:

the machines reference data (machine LUT) associating a plurality of machines with respective machine identification data thereof; and reference machine data 120.21 per each machine of the plurality of machines in the machines reference data, including the reference mapping data associated with each said machine;

a processor (not specifically shown);

machines reference data retriever 116 executed by said processor and configured and operable to utilize said network communication module and said reference data storage to carry out the operation (a); and machine's manager/activator 120 executed by the processor and configured and operable to utilize the network communication to carry out the operation (b).

It should be noted that also in the embodiment of FIG. 4A the system 100 may be configured and operable for displaying additional controls 190.VC (as exemplified in FIGS. 3A-3B referred to herein above as virtual controls) on the screen 170.Disp of the client station 170.1. The virtual controls 190.VC, provide the user of the client station's with functionality that may not be available to him via interaction with the static/dynamic controls of the image of the gaming machine which is presented on the display 170.Disp. For example, the additional/virtual controls 190.VC may include navigation controls allowing the user to navigate between machines, video and/or audio controls allowing the user to control the presentation and sounds provided to him at the client station, billing controls allowing the user, and possibly also controls which are aimed at replacing some of the controls which actually exists on the machine, to improve their usability by the user of the client station which uses the machine from remote. As indicated above virtual controls 190.VC may be presented as an overlay over the image IMG of the machine or in another place, e.g. aside that image.

Thus, the system 100 and method 200 presented in the embodiments above, provide a novel technique for providing users with remote controls of machines/systems such as remote control of on-line games on real/actual gaming machines, or remote control of ATMS or other machines, with obviation of direct physical interaction between the user and the machine. The technique of the invention may be used for providing casino services on-line based on actual casino gaming machines, and/or it may be used for controlling other types of machines by capturing and streaming a video of the machines and obtaining the interactions of a user with the video of the machine and translating/mapping these interactions to actual operations the user wishes to perform on the machine. A person of ordinary skill in the art would readily appreciate various modifications which may be applied to the embodiments presented above without departing from the scope of the present invention as defined in the claims.

The invention claimed is:

1. A system for remote control of machines via a user's client station that includes a user interface facilitating user interaction with the display, the system comprising:

wherein the system is configured and operable to carry out the following:

obtaining imagery of at least one machine having controls;

displaying at least part of said imagery at the display of the client station of the user;

receiving an input data from the user via the user interface of the client station; and activating said machine based on the input data;

wherein said input data is indicative of interactions of said user with one or more regions in said imagery of the machine that is being displayed at the display of the client station, at which respective one or more of said controls of the machine appear; and a machine manager processing the input data for associating said respective one or more controls of the machine with said one or more respective regions of said imagery with which the user interacted, and thereby map the user interactions with the one or more respective regions in said imagery to one or more of said respective controls, and determining certain operational instructions for activating said machine in accordance with the user interactions with the appearance of the one or more respective controls in said one or more regions in the imagery of the machine, which is displayed at the display of the client station.

2. The system of claim 1 wherein the machine manager comprises a controls' mapping module is configured and operable to obtain reference mapping data indicative of association between said one or more regions and said one or more respective controls of the machine.

3. The system of claim 2 wherein the input data provided by said user interface includes data indicative of a type and coordinates, of said user interaction with said respective regions of the display at which said displayed part of the imagery of the machine with the respective one or more controls is displayed;

wherein the controls' mapping module is configured and operable to obtain said reference mapping data such that it further includes data indicative of corresponding one or more operational instructions for activation of said one or more controls of the machine in response to the corresponding user interactions with said one or more regions of the display at which said one or more respective controls appear; and wherein the machines manager is further configured and operable to carrying out said determining of the certain operational instructions by selecting said certain operational instructions from said corresponding one or more operational instructions in accordance with the user interaction with the region of the display at which appears a corresponding control of said one or more respective controls; and wherein the machine manager is further capable of issuing an activation communication for activating said machine based on said certain operational instructions associated with said control of the machine.

4. The system of claim 2 further comprising:

a machine identifier module configured and operable for determining data indicative of an identity of the machine being captured by said imagery; and a reference data retriever module configured and operable for utilizing said data indicative of the identity of said machine to retrieve said reference mapping data for the identified machine.

5. The system of claim 4 wherein at least one of the following:

said machine identifier is connectable to a positioning module and is configured and operable for receiving data indicative of a position of at least an imager by which said imagery of a machine is captured, and utilizing said data to determine said identity of the machine based on said position of the system;

machine is assumed to be in vicinity of the position of the imager associated with the system; and said machine identifier utilizes machines reference data associating a plurality of machines with respective positions a thereof and determines the identity of said machine based on proximity between the position of the machine and the position of said system; or said machine identifier is connectable a marker reader adapted to read an identification marker associated with said machine.

6. The system of claim 5 wherein said identification marker is a visible identification marker appearing on said machine and including at least one of a barcode or a visible form identifying said machine; and wherein said marker reader is includes an image processor adapted to process an image of the machine to recognize said identification marker of the machine thereby determine said identity of the machine.

7. The system of claim 2 wherein said imager is mobile thereby providing said imagery of the machine with non-predetermined position and orientation coordinates relative to said machine; the reference mapping data includes: (i) data indicative of a reference model of appearance of the identified machine, and (ii) reference map associating one or more regions of said reference model with one or more respective controls of the identified machine located at said regions of the reference model respectively; and wherein the controls mapping module is configured and operable for processing the reference map associating the one or more regions of said reference model with one or more respective controls of the identified machine based on said spatial registration between said reference model and the displayed part of the imagery, and thereby determine an actual map associating the one or more regions of at least said displayed part of the imagery of the captured machine with the one or more respective controls of the identified machine located at said regions of displayed part of the imagery and their corresponding operational instructions for activating said respective controls of the identified machine; and wherein the machine manager is configured and operable for utilizing the actual map to carrying out said associating of the respective one or more controls of the machine with the one or more respective regions of the imagery with which the user interacted and to thereby accordingly carrying out said determining of the certain operational instructions.

8. The system of claim 7 wherein the reference model comprises one or more reference landmarks appearing on said machine; and said image/video processing module is configured and operable to process said at least displayed part of the imagery of the captured machine to identify appearance of said landmarks therein, determine a landmarks' spatial registration indicative of the registration between the reference landmarks in said reference model and the appearance of said reference landmarks in the imagery and processing said landmarks' spatial registration utilizing at least one of extrapolation and interpolation, to determine said spatial registration between said reference model and the displayed part of the imagery of the captured machine.

9. The system of claim 7 wherein the reference model comprises a reference image of at least a part of the machine; and said image/video processing module is configured and operable to apply image/pattern recognition determine the special registration between said reference model and the displayed part of the imagery of the captured machine.

10. The system of claim 7 wherein in determining said spatial registration, said image/video processing module carries out at least one or both of the following:

applies one or more spatial transformations to the imagery of the at least part of the machine, to obtain one or more transformed images, and determine the transformed image having a best fit with said reference model and a corresponding spatial transformation associated therewith, and determining said spatial registration based on said corresponding spatial transformation;

applies one or more spatial transformations to the reference model to obtain one or more transformed models, and determine the transformed model having a best fit with said imagery of the at least part of the machine reference model and a corresponding spatial transformation associated therewith, and determining said spatial registration based on said corresponding spatial transformation;

and wherein said spatial transformation comprise a combination of one or more of the following carried out with respect to one or more scaling or rotation: tilt, rotate, warp, scale, perspective transformation, zoom-in/out.

11. The system of claim 7 wherein said imagery is video imagery whereby appearance of said machine may move relative to frame of said video imager, and wherein said image/video processing module is adapted to track the spatial registration across the video frames.

12. The system of claim 11 wherein said tracking of the spatial registration comprises utilizing inertial sensors to monitor movements of said system and utilize said movements at least one of:

update said spatial registration according to said movements; or stabilize said displayed imagery of the at least part of the machine shown on said display based on said movements.

13. The system of claim 7 wherein said an image/video processing module is configured and operable to determine said spatial registration between said reference model and the displayed part of the imagery of the captured machine such that said spatial registration comprises model mapping of one or more respective spatial regions of said model to one or more spatial regions in the imagery of the captured machine; said a mapper configured and operable for utilizing said model mapping to map the one or more respective controls of the identified machine located at said respective spatial regions of said model to corresponding spatial regions of said displayed part of the imagery of the captured machine at which said control appear, and thereby determine said actual mapping data associating respective spatial regions of said displayed part of the imagery of the captured machine with corresponding operational instructions for activating the corresponding controls of the identified machine, which appear at said spatial regions of the imagery of the captured machine, upon user interaction with the respective spatial regions of the imagery at which said corresponding controls appear.

14. The system of claim 1 further comprising a network module configured and operable for communicating with an application-server serving as a machines remote control server over a network to carry out the following:

(a) provide said server, with machine identification data indicative of the identity of the machine captured by the imager to receive, in response from said server, said data indicative of the reference mapping data of said machine;

(b) provide said server, with the activation communication data indicative of certain operational instructions for activating said machine according to the user interaction with said control of the machine displayed at said coordinates of the display with which said user has interacted, based on the type of interaction of said user with said coordinates at which said control of the machine appears on said display.

15. The system of claim 14 whereby said server comprising the machines reference data associating a plurality of machines with respective machine identification data thereof; whereby the machine identification data comprises at least one of: data indicative of a position of said machine; data indicative of appearance of said machine; or data indicative of identification marker of said machine.

16. The system of claim 14 whereby in response to said activation data, the server establishes a communication with a communication module associated with at least one of: (i) a controller of said machine, and (ii) a relay device connected to the controls of the machine, for providing said certain operational instructions thereto; and wherein said at least one of the (i) controller of said machine and the (ii) relay module connected machine, is configured to receive said operational instructions and activate the machine accordingly.

17. A machines remote control server configured and operable for operating over a network to carry out the following:

(a) provide reference machine data to a client device of a user, comprising:

i) receiving machine identification data indicative of the identity of a machine captured by an imager of a user;

ii) processing said identification data utilizing machines reference data, which is stored in memory associated with said server and comprises data associating a plurality of machines with respective machine identification data thereof, to determine identity of said machine;

iii) utilizing said identity of the machine to search in a reference data storage for reference machine data associated with said machine, including: (i) reference model of appearance of the identified machine, and (ii) reference mapping data associating one or more regions of said reference model with one or more respective controls of the identified machine located at said regions of the reference model respectively, and corresponding operational instructions for activating said respective controls of the identified machine;

iv) provide said reference machine data to the client device of the user; and (b) activate the machine based on operational instructions from the client device of a user, client device of a user, comprising:

i) receiving, from the client device, activation communication data indicative of certain operational instructions for activating the machine according to user's interaction with a control of the machine displayed at certain coordinates of a display of the client device with which a user of said device has interacted, and at which said control of the machine appears on said display;

ii) utilizing the identification data of the machine to determine, based on said machines reference data, which is stored in the memory associated with said server, communication parameters of for communicating with said machine directly or via a relay;

iii) utilizing said communication parameters for establishing of for communicating with said machine directly or via a relay, to provide said machine directly, or said relay with instructions for activating said machine according to said certain operational instructions.

18. The system of claim 17 whereby said machines remote control server comprises:

a network communication module;

a reference data storage comprising:

said machines reference data associating a plurality of machines with respective machine identification data thereof; and reference machine data per each machine of the plurality of machines in the machines reference data, including: said (i) reference model of appearance of the identified machine, and said (ii) reference mapping data associated with each said machine;

a processor;

a machines' reference data retriever executed by said processor and configured and operable to utilize said network communication module and said reference data storage to carry out the operation (a)

a machine's manager executed by said processor and configured and operable to utilize said network communication module to carry out the operation (b).

19. A method for remote control of machines via a user's client station that includes a display and a user interface; the method comprising:

obtaining imagery of at least one machine having controls;

displaying at least part of said imagery at the display of the client station of the user;

receiving an input data from the user via the user interface of the client station;

activating said machine based on the input data;

wherein said input data is indicative of interactions of said user with one or more regions in said imagery of the machine that is being displayed at the display of the client station, at which respective one or more of said controls of the machine appear; and processing the input data for associating said respective one or more controls of the machine with said one or more respective regions of said imagery with which the user interacted, and thereby mapping the user interactions with the one or more respective regions in said imagery to one or more of said respective controls, and determining certain operational instructions for activating said machine in accordance with the user interactions with the appearance of the one or more respective controls in said one or more regions in the imagery of the machine, which is displayed at the display of the client station.

20. A non-transitory computer readable storage medium having data stored therein representing computer readable code including instructions executable by one or more computerized systems for carrying out the following in order to remote control of machines via a user's client station that includes a display and a user interface, the instructions comprising:

obtaining imagery of at least one machine having controls;

displaying at least part of said imagery at the display of the client station of the user;

receiving an input data from the user via the user interface of the client station; and activating said machine based on the input data;

wherein said input data is indicative of interactions of said user with one or more regions in said imagery of the machine that is being displayed at the display of the client station, at which respective one or more of said controls of the machine appear; and processing the input data for associating said respective one or more controls of the machine with said one or more respective regions of said imagery with which the user interacted, and thereby mapping the user interactions with the one or more respective regions in said imagery to one or more of said respective controls, and determining certain operational instructions for activating said machine in accordance with the user interactions with the appearance of the one or more respective controls in said one or more regions in the imagery of the machine, which is displayed at the display of the client station.

* * * * *